US008496139B2

(12) United States Patent
Nishino

(10) Patent No.: US 8,496,139 B2
(45) Date of Patent: Jul. 30, 2013

(54) BEVERAGE SERVER SYSTEM

(71) Applicant: Ryo Nishino, Nagano (JP)

(72) Inventor: Ryo Nishino, Nagano (JP)

( * ) Notice: Subject to any disclaimer, the term of this patent is extended or adjusted under 35 U.S.C. 154(b) by 0 days.

(21) Appl. No.: 13/733,626

(22) Filed: Jan. 3, 2013

(65) Prior Publication Data

US 2013/0119085 A1 May 16, 2013

Related U.S. Application Data

(60) Division of application No. 12/592,792, filed on Dec. 3, 2009, now Pat. No. 8,348,097, which is a continuation-in-part of application No. PCT/JP2008/059676, filed on May 26, 2008.

(30) Foreign Application Priority Data

Jun. 4, 2007 (JP) ..... 2007-148650
Oct. 18, 2007 (JP) ..... 2007-271768

(51) Int. Cl.

| | |
|---|---|
| ***B67D 1/00*** | (2006.01) |
| ***B67D 1/08*** | (2006.01) |
| ***B67D 7/84*** | (2010.01) |
| ***B65D 5/66*** | (2006.01) |

(52) U.S. Cl.
USPC ..... 222/91; 222/113; 222/152; 222/164; 222/399; 222/400.7; 222/400.8

(58) Field of Classification Search
USPC ..... 222/81–83, 91, 113, 152, 164, 185.1, 222/394, 399, 400.7, 400.8, 464.3, 464.5; 261/76; 99/326.1; 426/474
See application file for complete search history.

(56) References Cited

U.S. PATENT DOCUMENTS

| | | | | | |
|---|---|---|---|---|---|
| 354,150 | A | * | 12/1886 | Jones | 222/91 |
| 587,987 | A | * | 8/1897 | Mills | 222/400.7 |
| 757,794 | A | * | 4/1904 | Walker | 222/91 |
| 950,295 | A | * | 2/1910 | Marsden, et al. | 137/212 |
| 968,378 | A | * | 8/1910 | Marsden | 62/171 |
| 2,013,685 | A | * | 9/1935 | Reed-Hill | 137/154 |
| 2,017,365 | A | * | 10/1935 | Klein | 137/318 |
| 2,017,879 | A | * | 10/1935 | Wiechmann | 261/121.1 |
| 2,120,297 | A | * | 6/1938 | Reinecke | 261/122.1 |
| 2,310,714 | A | * | 2/1943 | Slaughter | 222/400.7 |
| 2,547,450 | A | * | 4/1951 | DuPont | 222/113 |
| 2,598,357 | A | * | 5/1952 | Coleman | 222/113 |
| 2,955,729 | A | * | 10/1960 | Kish | 222/400.7 |
| 3,186,599 | A | * | 6/1965 | Levinson et al. | 222/82 |
| 3,227,310 | A | * | 1/1966 | Farandatos | 222/5 |

(Continued)

*Primary Examiner* — Paul R Durand
*Assistant Examiner* — Vishal Pancholi
(74) *Attorney, Agent, or Firm* — Larry E. Henneman, Jr.; Gregory P. Gibson; Henneman & Associates, PLC

(57) ABSTRACT

A beverage server system for extracting a beverage from a corked beverage bottle without uncorking the bottle includes a penetration element for penetrating the cork. The penetration element includes a beverage extraction conduit for extracting the beverage from the bottle and a gas injection conduit for injecting gas into the bottle. A gas injection port disposed in the gas injection conduit is located at a level higher than a beverage extraction port disposed in the beverage extraction conduit in the bottle when extracting the beverage from the bottle through the beverage extraction conduit. The beverage server system has a simple structure, extracts beverage from the bottle without causing contact of the beverage inside the beverage bottle with air, and is easy to operate, maintain, and introduce into a household.

16 Claims, 28 Drawing Sheets

U.S. PATENT DOCUMENTS 3,846,518 A * 11/1974 McPhee ..... 261/123
3,976,221 A * 8/1976 Martin et al. ..... 222/61
4,392,578 A * 7/1983 Fipp et al. ..... 215/231
4,473,174 A * 9/1984 Heuser ..... 222/152
4,706,847 A * 11/1987 Sankey et al. ..... 222/1
4,850,387 A * 7/1989 Bassill ..... 137/212
4,856,680 A * 8/1989 Sitton ..... 222/152
5,022,565 A * 6/1991 Sturman et al. ..... 222/396
5,139,179 A * 8/1992 Cecil ..... 222/399
5,769,135 A * 6/1998 Mahlich ..... 141/70
5,853,113 A * 12/1998 Small et al. ..... 222/379
6,059,145 A * 5/2000 Stratton et al. ..... 222/78
6,145,705 A * 11/2000 Wallace et al. ..... 222/162
6,651,852 B2 * 11/2003 Arellano ..... 222/399
6,666,355 B2 * 12/2003 Padar ..... 222/152
2005/0178801 A1 * 8/2005 Lambrecht ..... 222/399

* cited by examiner

BEVERAGE SERVER SYSTEM

CROSS REFERENCE TO RELATED APPLICATIONS

This application is a division of U.S. patent application Ser. No. 12/592,792 (now U.S. Pat. No. 8,348,097), filed Dec. 3, 2009 by the same inventor, which is a continuation-in-part of International Application No. PCT/JP2008/059676 filed May 26, 2008 by the same inventor (published under PCT Article 21(2) in Japanese and not English), which claims priority to Japanese Application No. 2007-148650 (filed Jun. 4, 2007) and Japanese Application No. 2007-271768 (filed Oct. 18, 2007), all of which are incorporated herein by reference in their entirety.

FIELD OF THE INVENTION

This invention relates to a beverage server system, and specifically relates to a beverage server system which enables to extract a beverage from a corked beverage bottle without causing contact of the beverage inside the beverage bottle with air, especially without contaminating lees included in most high-grade wines.

DESCRIPTION OF THE RELATED ART

Wine boom has continued so far since: wines have a fashionable image due to France which is one of the main wine production countries; they are produced with good qualities not only in Europe such as Italy and Germany but also in the United State (California) and South America such as Chile; they are very deep in terms of their taste and aroma differences depending on production areas and their food combinations; and they have been scientifically proved their goodness for our health.

The wine is filled into a wine bottle made of glass and a mouth of the wine bottle is sealed with a cork to be distributed, which is a particular mode among alcohols. Such the sealing with cork is for a wine's property that its flavor is damaged by contact with even a slight amount of air. That is, just one contact of wine with oxygen included in air causes to progress wine deterioration even after blocking the oxygen, continue changing the taste and aroma and degrade the flavor.

Accordingly, due to contact of wine inside the bottle with air when the wine bottle is uncorked, it is preferable to finish drinking wine inside the uncorked wine before the flavor gets worse.

However, a wine bottle size is normally 750 ml and it is considered too much to finish drinking with a small group. Some wines are sold in a half-sized bottle, but they are few. This is because a production of the half-sized bottle is rather expensive, and wine quality in the half-sized bottle is unstable.

Therefore, when drinking wine with a small group at general household or serving wine in a glass at restaurant, it is difficult to finish drinking a whole 750 ml bottle of wine after being uncorked and before its flavor gets worse, which results in leaving some of the wine.

For the wine remaining in the wine bottle, a set of a plug and a handy-sized pump for removing air inside the wine bottle is sold. The plug is inserted through a mouth of the wine bottle and covered with the handy-sized pump to deflate air, and thereafter the pump is removed. This enables to keep the wine in vacuum with the plug without causing a deterioration of an immediate flavor after being uncorked, and preserve the half-finished wine in a fresh state.

Also, a purpose-built plug to be inserted into a mouth of the wine bottle is sold, wherein inactive gas is sent from a gas canister to the wine bottle through the plug.

However, in both of these ways, wine inside the wine bottle contacts with air once so that it is impossible to stop the deterioration of wine in the bottle as described above, even though evacuating the inside of the bottle just after being uncorked or sending inactive gas to the inside of the bottle.

Then, a fluid extraction device (Japanese Patent No. 3601823 (Reissued Patent Publication)) for extracting wine from a wine bottle without causing contact of wine with air, and a plug replacing device (Japanese Patent No. 3649334 (Reissued Patent Publication)) for pulling out a cork and replacing it with a flow-valve used in the above-mentioned fluid extraction device are disclosed.

This fluid extraction device comprises a body including a fluid reservoir for reserving fluid under air-tight conditions, a mount part for mounting a head of an upside-down bottle on an upper part of the fluid reservoir under air-tight conditions as well as flowing fluid from the bottle head to the fluid reservoir via the flow-valve under air-tight conditions, an extraction part for flowing the fluid inside the fluid reservoir via an extraction valve, a gas supply port for supplying degradation prevention gas to the fluid reservoir, a first drive for operating the flow-valve, and a second drive for operating the extraction valve.

Further, the plug replacing device comprises an air-tight chamber removably attached to the bottle head, a gas supply port for supplying nitrogen gas to the chamber, a purge valve for discharging air inside the chamber, a first elevatable support for supporting a cork screw, and a second elevatable support for receiving an alternative plug.

The plug replacing device enables to replace an existing bottle plug with the alternative plug (flow-valve), without causing an air entry into the bottle. Further, the fluid extraction device with the flow-valve enables to extract a certain amount of fluid such as wine as needed, and perform a simple operation for the extraction and achieve long-term preservation.

However, the fluid extraction device reserves wine transferred from the wine bottle into the fluid reservoir of the body once and flows and extracts the wine inside the fluid reservoir from the extraction part via the extraction valve while supplying gas to the fluid reservoir for preventing the degradation of wine, which is a complicated and large-scale apparatus. Such apparatus is expensive, and requires maintenance by engineers even the operation for extracting wine is simple, which results in high running cost.

Accordingly, it is not possible to casually buy the above-mentioned fluid extraction device for use at household, and it is not easy to introduce it even at restaurant if the sales volume of wine is not so much.

In addition, the above-mentioned fluid extraction device requires to place the wine bottle upside-down and to mount its bottle head on the upper part of the fluid reservoir. However, in the wine industry where the visual appearance is important, it is not so appropriate to pour wine into a wine glass with showing the upside-down bottle. On the other hand, wine has a different taste and aroma depending on the production areas as mentioned above so that it is necessary to pour wine into a wine glass with showing its label which displays the production area. As described, the above-mentioned fluid extraction device is not able to extract wine with attention to the visual appearance in front of customers.

Further, the fluid reservoir-equipped body is connected to a gas generator and the like so that it can not be easily moved. Therefore, it is difficult to extract wine in front of customers in each table.

These problems are applied to not only wine but also other corked beverages such as Sake.

By contrast, Tokkaisho 50-66384 discloses a wine dispenser for extracting wine from a corked bottle, which has a more simple structure than the devices disclosed in Japanese Patent No. 3601823 and No. 3649334 (Reissued Patent Publication).

However, the device disclosed in Tokkaisho 50-66384 extracts wine together with lees included in most vintage red wines, which is a big problem.

Specifically, according to the device disclosed in Tokkaisho 50-66384, an inactive gas supply port and a wine extraction port are entered into wine and adjacently positioned at the same level, which allows most of lees agitated and stirred up due to the supply of inactive gas to be poured out through the extraction port together with wine.

SUMMARY OF INVENTION

This invention is to solve the above problems of related art, and to provide a beverage server system having a simple structure, which enables to extract a beverage from a beverage bottle without causing contact of the beverage inside the beverage bottle with air and without contaminating lees included in most high-grade wines, and excels in easy operation for extracting the beverage, easy maintenance and easy introduction into household.

Also, this invention provides a beverage server system, which allows to operate the beverage extraction with attention to its visual appearance.

The present invention relates to a beverage server system for extracting a beverage from a corked beverage bottle without uncorking the bottle, comprising: a penetration element for penetrating through the cork, the penetration element including a beverage extraction conduit for extracting the beverage in the bottle and a gas injection conduit for injecting gas into the bottle, wherein a gas injection port disposed in the gas injection conduit is located at a level higher than a beverage extraction port disposed in the beverage extraction conduit inside the bottle when extracting the beverage from the bottle through the beverage extraction conduit, the penetration element has a double tube structure in which the beverage extraction conduit is incorporated into the gas injection conduit, the beverage extraction conduit is movable along the gas injection conduit so as to change its protrusive amount from the gas injection conduit, and the gas injection port opens when moving the beverage extraction conduit in a direction of increasing its protrusive amount from the gas injection conduit.

Another embodiment of the present invention relates to the beverage server system, wherein a thread is formed on an outer circumference surface of the gas injection conduit.

Yet another embodiment of present invention relates to a beverage server system for extracting a beverage from a corked beverage bottle without uncorking the bottle, comprising: a penetration element for penetrating through the cork, the penetration element including a beverage extraction conduit for extracting the beverage in the bottle and a gas injection conduit for injecting gas into the bottle, wherein a gas injection port disposed in the gas injection conduit is located at a level higher than a beverage extraction port disposed in the beverage extraction conduit inside the bottle when extracting the beverage from the bottle through the beverage extraction conduit, the penetration element has a double tube structure in which the gas injection conduit is incorporated into the beverage extraction conduit, the gas injection conduit is movable along the beverage extraction conduit so as to change its protrusive amount from the beverage extraction conduit, and the beverage extraction port opens when moving the gas injection conduit in a direction of increasing its protrusive amount from the beverage extraction conduit.

Yet embodiment of the present invention relates to the beverage server system, wherein a thread is formed on an outer circumference surface of the beverage extraction conduit.

Yet another embodiment of the present invention relates to the beverage server system, wherein a body is provided above the penetration element and extended at a substantial right angle to the penetration element, the body comprising: a beverage extraction channel for guiding the beverage to outside, the beverage extraction channel communicated with the beverage extraction conduit; and a gas injection channel for introducing gas from outside, the gas injection channel communicated with the gas injection conduit.

Yet another embodiment of the present invention relates to the beverage server system, comprising: a beverage discharge channel for discharging the beverage, the beverage discharge channel removably attached to the beverage extraction channel, and a gas supply channel for supplying gas, the gas supply channel removably attached to the gas injection channel.

Yet another embodiment of the present invention relates to the beverage server system, wherein the gas supply channel comprises at a tip thereof: a jointed-part to be jointed to a jointing-part, the jointing-part disposed on a tip of the gas injection channel; and a cap for covering an outer circumference of the jointed-part, wherein the cap comprises a valve for discharging gas inside the cap to outside when a pressure inside the cap exceeds a predetermined value, the cap is configured to connect to the body and incorporate the jointing-part and the jointed-part, and an inside of the cap is air-tight when the connection is performed.

Yet another embodiment of the present invention relates to the beverage server system, further comprising a rack, wherein the rack incorporates a gas canister therein for supplying gas to the gas injection conduit and holds the beverage bottle above the gas canister by tilting a mouth of the bottle lower than a bottom of the bottle.

Yet another embodiment of the present invention relates to the beverage server system, further comprising a rack, wherein the rack incorporates a gas canister therein for supplying gas to the gas injection conduit and holds the beverage bottle in an upright position.

Yet another embodiment of the present invention relates to the beverage server system, further comprising a rack, wherein the rack incorporates a gas canister therein for supplying gas to the gas injection conduit and holds the beverage bottle at an alterable tilt angle.

Yet another embodiment of the present invention relates to the beverage server system, wherein the rack comprises a light tool for illuminating an inside of the beverage bottle.

Yet another embodiment of the present invention relates to the beverage server system, the light tool is placed inside a box, the box incorporating the gas canister therein, and the box comprises a transparent plate on its surface facing the beverage bottle, the transparent plate transmitting light from the light tool.

Yet another embodiment of the present invention relates to the beverage server system, the light tool is placed inside a box, the box incorporating the gas canister therein, and the box comprises a transparent plate on its surface facing the beverage bottle, the transparent plate transmitting light from the light tool.

Yet another embodiment of the present invention relates to the beverage server system, wherein the body comprises: a motor for independently rotating the penetration element from the body; and a battery for supplying power to the motor.

According to one embodiment of the present invention, a penetration element punctures and penetrates through a cork of a corked beverage bottle, which enables to supply gas from a gas injection port to an inner of the bottle and extract a beverage through a beverage extraction conduit under air-tight conditions due to an elasticity of cork. Therefore, this simple structure enables to extract the beverage from the beverage bottle without causing contact of the beverage inside the beverage bottle with air.

Also, the gas injection port which is disposed in a gas injection conduit is located at a level higher than a beverage extraction port which is disposed in the beverage extraction conduit in the bottle when extracting the beverage from the bottle through the beverage extraction conduit. That is, the gas injection port is located at a level higher than the beverage extraction port when injecting gas, which results in preventing lees stirred up by the gas injection from being extracted via the beverage extraction port.

Next, the beverage extraction conduit is incorporated into the gas injection conduit and movable along the gas injection conduit to change its protrusive amount from the gas injection conduit, and the gas injection port opens when moving the beverage extraction conduit in a direction of increasing the protrusive amount from the gas injection conduit. This enables to extract wine without causing contact of the gas injection conduit with wine. Accordingly, bubbles of injected gas do not occur in the wine, which results in preventing the stir-up of lees in wine.

In addition, the gas injection port is not at an open state when puncturing through the cork with the penetration element, which results in preventing the cork powder from clogging into the gas injection port.

Further, the beverage extraction port is at a state which is covered with the gas injection conduit when puncturing through the cork with the penetration element, which results in preventing the cork powder from clogging into the beverage extraction port.

According to another embodiment of the present invention, a thread is formed on an outer circumference surface of the gas injection conduit. This enables to easily penetrate through the cork with the gas injection conduit incorporating the beverage extraction conduit, and also improve airtightness due to the elasticity of cork.

According to yet another embodiment of the present invention, a penetration element punctures and penetrates through a cork of a corked beverage bottle, which enables to supply gas from a gas injection port to an inner of the bottle and extract a beverage through a beverage extraction conduit under air-tight conditions due to an elasticity of cork. Therefore, this simple structure enables to extract the beverage from the beverage bottle without causing contact of the beverage inside the beverage bottle with air.

Also, the gas injection port which is disposed in a gas injection conduit is located at a level higher than a beverage extraction port which is disposed in the beverage extraction conduit in the bottle when extracting the beverage from the bottle through the beverage extraction conduit. That is, the gas injection port is located at a level higher than the beverage extraction port when injecting gas, which results in preventing lees stirred up by the gas injection from being extracted via the beverage extraction port.

Next, the gas injection conduit is incorporated into the beverage extraction conduit and movable along the beverage extraction conduit to change its protrusive amount from the beverage extraction conduit, and the beverage extraction port opens when moving the gas injection conduit in a direction of increasing its protrusive amount from the beverage extraction conduit. This enables to extract wine by tilting the bottle downward with an angle and positioning the gas injection port higher than the beverage extraction port, which results in preventing lees of wine from being extracted via the beverage extraction port.

In addition, the beverage extraction port is not at an open state when the penetration element punctures through the cork, which results in preventing the cork powder from clogging into the beverage extraction port.

Further, the gas injection port is at a state which is covered with the beverage extraction conduit when the penetration element punctures through the cork, which results in preventing the cork powder from clogging into the gas injection port.

According to yet another embodiment of the present invention, a thread is formed on an outer circumference surface of the beverage extraction conduit. This enables to easily penetrate through the cork with the beverage extraction conduit incorporating the gas injection conduit, and also improve airtightness provided from the elasticity of cork.

According to yet another embodiment of the present invention, a body is provided above the penetration element and extended at a substantial right angle to the penetration element. This enables to perform an operation of penetrating through the cork with the penetration element by gripping the body, which results in easily operating the penetration.

According to yet another embodiment of the present invention, a beverage discharge channel for discharging the beverage, the beverage discharge channel removably attached to the beverage extraction channel outside the bottle, and a gas supply channel for supplying gas, and the gas supply channel removably attached to the gas injection channel outside the bottle are provided. This enables to operate the beverage extraction with attaching/removing the beverage discharge channel and the gas supply channel as needed, which excels in workability.

According to yet another embodiment of the present invention, a cap is connected to the body, and thereafter gas is supplied under a state that a jointing-part and a jointed-part are not jointed. This enables to increase a gas pressure inside the cap and release a valve, which leads to discharge air inside the cap together with gas to outside. After that, the jointing-part and the jointed-part are jointed under a state that the inner of the cap is fulfilled with gas.

Accordingly, it is possible to easily operate the puncture of the penetration element through the cork by removing the gas supply channel once, and prevent a slight amount of air remaining in the jointing-part from coming into the bottle via the gas injection channel and the like when the gas supply channel is reconnected.

According to yet another embodiment of the present invention, a rack is further provided, wherein the rack incorporates a gas canister therein for supplying gas to the gas supply channel and holds the beverage bottle above the gas canister with tilting a mouth of the beverage bottle lower than a bottom of the bottle. The tilt of the bottle at an appropriate level enables to easily operate the beverage extraction, and the position of the beverage bottle above the gas canister enables to perform the beverage extraction with a small space and also preserve the bottle as it now stands. Further, the structure excels in the visual appearance because it is capable of being compact and showing a label of the beverage bottle, and contributes to an appropriate use of the wine extraction where the visual appearance is especially important.

According to yet another embodiment of the present invention, a rack is further provided, wherein the rack incorporates a gas canister therein for supplying gas to the gas supply channel and holds the beverage bottle in an upright position. This enables to serve wine at the upright position without tilting the bottle.

This enables to prevent the stir-up of lees of wine existing at the bottom of the bottle and also to serve wine by being kept in a wine cooler.

According to yet another embodiment of the present invention, a rack is further provided, wherein the rack incorporates a gas canister therein for supplying gas to the gas supply channel and holds the beverage bottle at an alterable tilt angle. The angle of the rack is freely adjusted so as to appropriately remove lees with observing the state of lees wherever the lees are, i.e., at top, middle or bottom of the bottle.

According to yet another embodiment of the present invention, the rack comprises a light tool for illuminating an inside of the beverage bottle, which enables to serve wine with observing a position of lees, and operate the serving very easily.

According to yet another embodiment of the present invention, the light tool is placed inside a box incorporating the gas canister therein, and the box comprises a transparent plate on its surface facing the beverage bottle, the transparent plate transmitting light from the light tool. This enables to illuminate light without showing the light tool to anyone, which excels in the visual appearance. This also achieves a compact size of the device.

According to yet another embodiment of the present invention, the body comprises a ratchet mechanism. This enables to very easily operate the puncture through the cork with the penetration element.

According to yet another embodiment of the present invention, the body comprises a motor for independently rotating the penetration element from the body, and a battery for supplying power to the motor. This enables to operate the puncture through the cork with the penetration element in a substantially automatic way, which results in reducing the amount of human labor.

DESCRIPTION OF THE PREFERRED EMBODIMENTS

Hereinafter, preferable embodiments of a beverage server system according to the present invention will be explained by referring to drawings.

Figure 1:
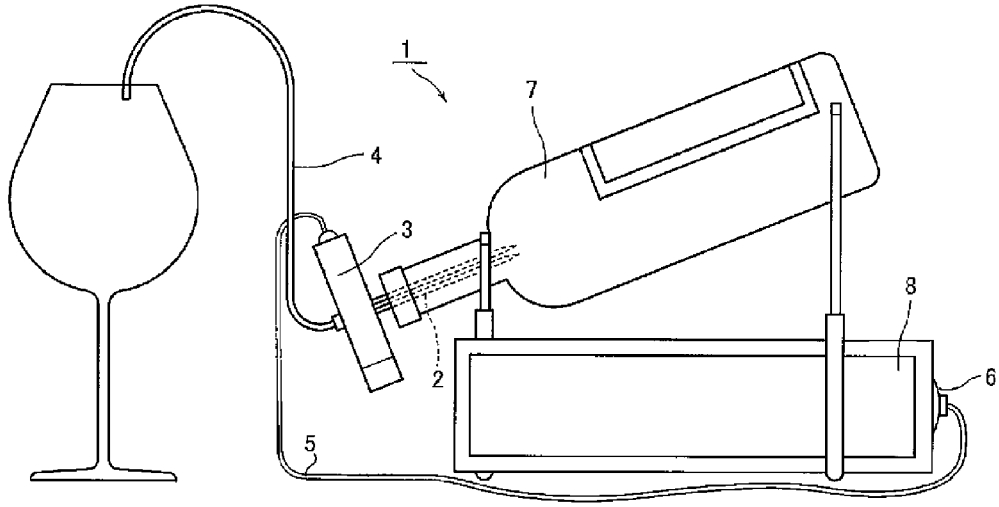
FIG. 1 schematically shows an entire structure of the beverage server system according to the first embodiment of the present invention.
Figure 2:
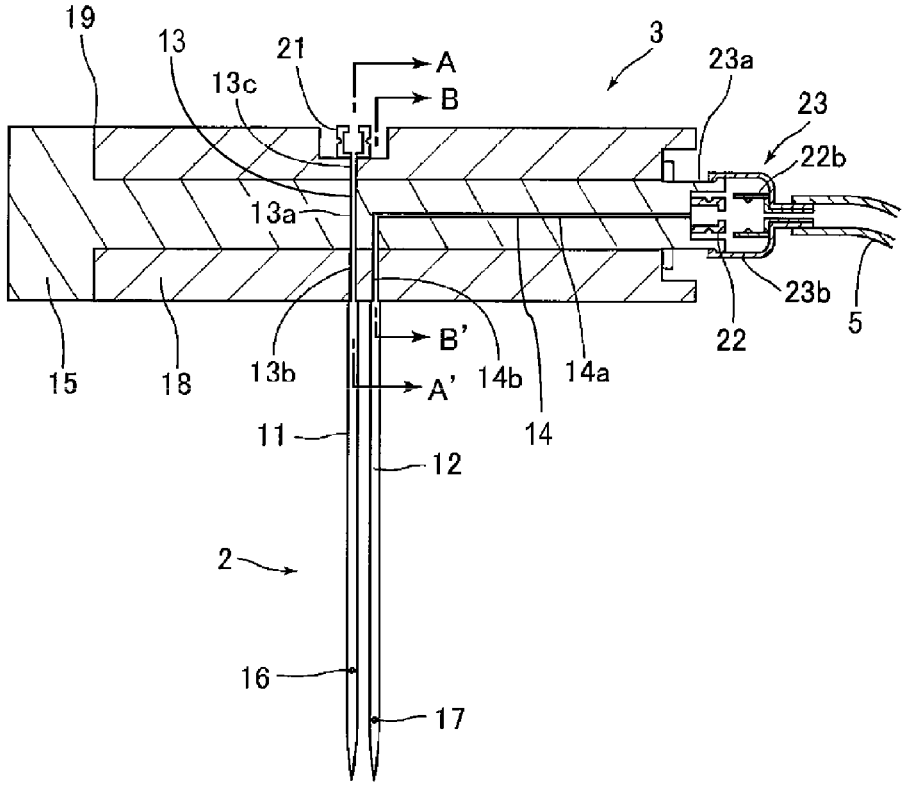
FIG. 2 is a cross-section view of a body and a penetration element shown in FIG. 1.
Figure 3:
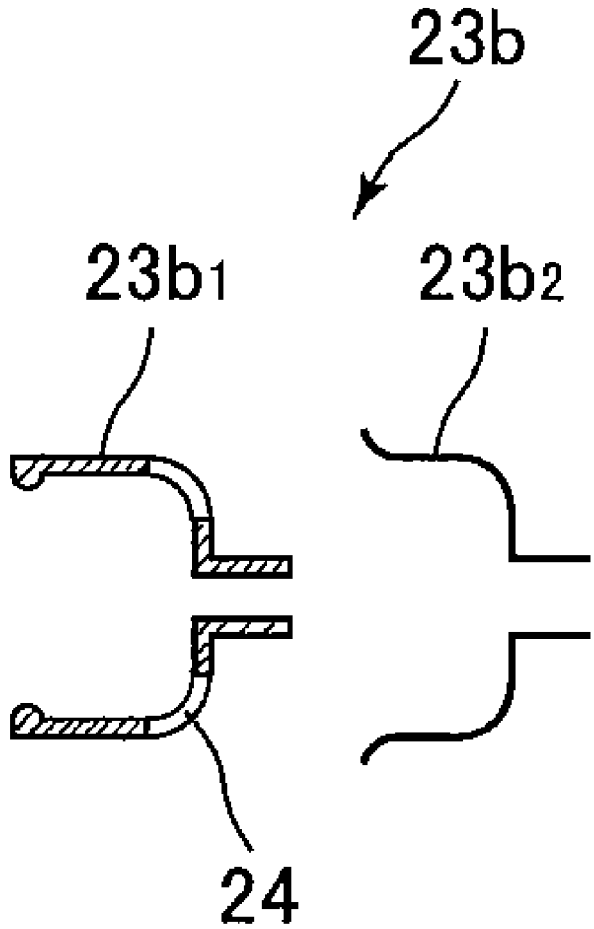
FIG. 3 is an exploded cross-section view of a cap shown in FIG. 2.
Figure 4:
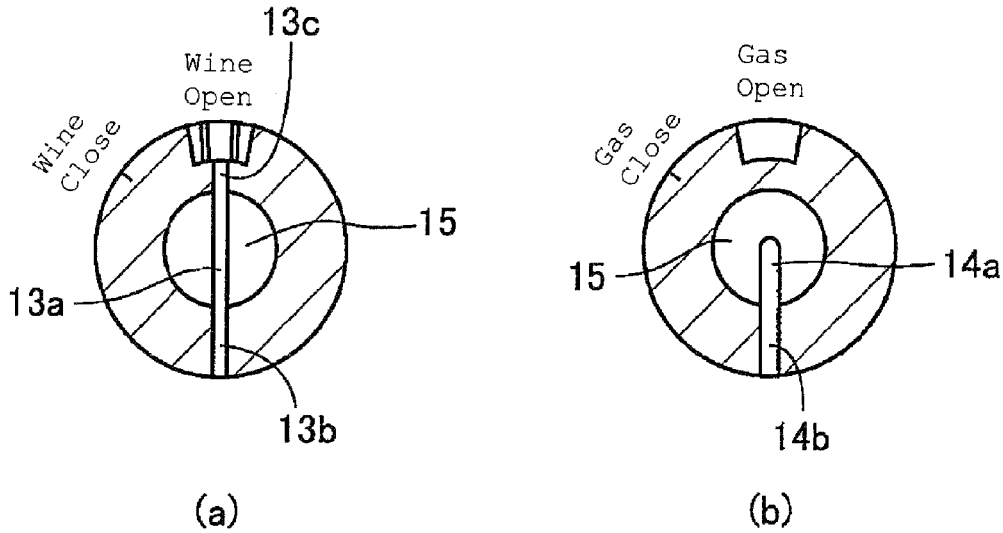
FIG. 4 (*a*) is a cross-section view taken from line A-A' of FIG. 2, and FIG. 4 (*b*) is a cross-section view taken from line B-B' of FIG. 2.

FIG. 1 schematically shows an entire structure of a beverage server system according to the first embodiment of the present invention. FIG. 2 is a cross-section view of a body and a penetration element shown in FIG. 1. FIG. 3 is an exploded cross-section view of a cap shown in FIG. 2. FIG. 4 (*a*) is a cross-section view taken from line A-A' of FIG. 2, and FIG. 4 (*b*) is a cross-section view taken from line B-B' of FIG. 2.

A beverage server system (1) according to the present invention is to extract a beverage from a corked beverage bottle without uncorking the bottle. FIG. 1 shows an example for extracting wine from a wine bottle (7).

The beverage server system (1) comprises a penetration element (2) for puncturing and penetrating through a cork so as to reach to a beverage inside the bottle, a body (3) attached to the penetration element (2), a beverage discharge channel (4) for discharging the beverage, and a gas supply channel (5) for supplying gas. In the present invention, gas to be fed via the gas supply channel (5) is an inactive gas such as nitrogen.

Also, the illustrated figure comprises a wine rack (also called as just "rack") (8). The wine rack (8) incorporates a gas canister (6) therein, and the gas canister (6) is for supplying gas to the gas supply channel (5). The wine rack holds a wine bottle (7) with tilting a mouth of the bottle lower than a bottom of the bottle.

The penetration element (2) has a beverage extraction conduit (11) for extracting wine from the bottle and a gas injection conduit (12) for injecting gas into the bottle (See FIG. 2). The beverage extraction conduit (11) and the gas injection conduit (12) respectively have a hollow and long needle shape, and wine (beverage) and gas respectively pass through the hollow parts. When puncturing the cork with the long needle-like beverage extraction conduit (11) and the gas injection conduit (12), the two long needles are alternately pressed against the cork. Under the punctured state, an elasticity of cork provides airtightness between the penetration element (2) and the cork, which results in preventing air from coming into the bottle through the punctured part.

In addition, a beverage extraction port (16) is open at a tip of the hollow part of the beverage extraction conduit (11). A gas injection port (17) is open at a tip of the hollow part of the gas injection conduit (12) such that it penetrates the cork and enters into the bottle prior to the beverage extraction port (16). That is, the gas injection port (17) is located closer to the tip side than the beverage extraction port (16).

Accordingly, the gas injection port (17) enters into the bottle prior to the beverage extraction port (16) when the penetration element (2) punctures and penetrates through the cork and enters into the bottle while gas is supplied to the gas injection conduit (12), which leads to firstly inject gas into the bottle and raise the gas pressure. After the gas pressure rises, the beverage extraction port (16) enters into the bottle. At that point, even though air inside the beverage extraction conduit (11) tries to go into the bottle, gaseous matter originally existing inside an upper part of the bottle enters into the beverage extraction conduit (11) through the beverage extraction port (16) due to gas pressure, and the air is pushed out. Therefore, air inside the beverage extraction port (16) is difficult to enter into the bottle.

Further, when extracting the beverage from the bottle (See FIG. 1), the gas injection port (17) is located at a level higher than the beverage extraction port (16) in the bottle. This causes a difficulty for lees included in wine to enter into the beverage extraction port (16), and prevents lees from being extracted together with wine.

According to the present invention, in all embodiments described below, the gas injection port (17) is configured to be located at a level higher than the beverage extraction port (16) when extracting beverage from the bottle, which enables to prevent lees from being extracted together with wine.

The body (3) is attached and extended at a substantial right angle to the penetration element (2). The body (3) comprises a beverage extraction channel (13) for guiding the beverage to outside, the beverage extraction channel (13) communicated with the beverage extraction conduit (11), and a gas injection channel (14) for introducing the gas from outside, the gas injection channel (14) communicated with the gas injection conduit (12), and a rotatable cylinder (15) (a controller) for regulating the extraction of beverage from the beverage extraction conduit (11) and the injection of gas from the gas injection conduit (12).

The beverage discharge channel (4) is removably attached to the beverage extraction channel (13), and the gas supply channel (5) is removably attached to the gas injection channel (14).

The rotatable cylinder (15) is substantially cylindrical, and of which outer circumference is closely and rotatably attached to an inner circumference of a cylindrical grip (18). Therefore, the beverage extraction channel (13*a*) and the gas injection channel (14*a*) placed inside the rotatable cylinder (15) are also rotated in accordance with a rotation of the rotatable cylinder (15).

The body (3) comprises a scale (19).

The scale (19) sets a standard position at the grip (18), and sets an open position and a close position at the rotatable cylinder (15) (See FIG. 4).

When rotating the rotatable cylinder (15) to adjust the open position at the rotatable cylinder (15) to the standard position at the grip (18) as shown in FIG. 4, the beverage extraction channel (13*a*) inside the rotatable cylinder (15) and the beverage extraction channels (13*b*, 13*c*) inside the grip (18) are communicated together. At this time, the gas injection channel (14*a*) inside the rotatable cylinder (15) and the gas injection channel (14*b*) inside the grip (18) are also communicated together.

On the other hand, when adjusting the close position at the rotatable cylinder (15) to the standard position at grip (18), the beverage extraction channel (13*a*) inside the rotatable cylinder (15) and the beverage extraction channels (13*b*, 13*c*) inside the grip (18) are not communicated at all. At the same time, the gas injection channel (14*a*) inside the rotatable cylinder (15) and the gas injection channel (14*b*) inside the grip (18) are not communicated at all.

The beverage discharge channel (4) has a jointed-part (not shown) at its tip, and the jointed-part is fitted and connected to a jointing-part (21) provided at a tip of the beverage extraction channel (13*c*). As for the jointing-part (21), for example, a plug or socket for connecting gas pipes may be used. In addition, the jointing-part (21) has a check valve (not shown)

which opens due to a pressure from the beverage extraction channel (13) but does not open due to high pressure from the outside, which enables to prevent air from coming into the beverage extraction channel (13*c*).

Similarly, the gas injection channel (14*a*) has a jointing-part (22) at its tip, which is similar to the jointing-part (21), and the gas supply channel (5) is fitted and connected thereto.

The gas supply channel (5) comprises an air contamination prevention mechanism at its tip, which enables to be connected to the jointing-part (22) without causing air contamination to the gas injection channel (14*a*).

When gas which is inside the gas canister runs out, it is necessary to remove the gas supply channel (5) once for a replacement of the gas canister.

However, when removing once and reconnecting the gas supply channel (5), a slight amount of air which has been entered into the jointing-part (22) due to the removal of the gas supply channel (5) may enter into the bottle through the gas injection channel (14*a*) together with gas.

The air contamination prevention mechanism comprises a jointed-part (22*b*) to be jointed with the jointing-part (22) disposed at the tip of the gas injection channel (14), and a cap (23*b*) covering an outer circumference of the jointed-part (22*b*).

The cap (23*b*) is composed of a cap body (23$b_1$) which has an umbrella shape and is made of an elastic body such as transparent rubber, and a film (23$b_2$) which has also an umbrella shape and covers over a surface of the cap body (23$b_1$) (See FIG. 3).

The cap body (23$b_1$) has a gas discharge port (24). The gas discharge port (24) is blocked with the film (23$b_2$) in normal time, and it opens when the film (23$b_2$) is uplifted due to high pressure inside the cap body (23$b_1$). That is, the gas discharge port (24) and the film (23$b_2$) work as a basic valve.

As shown in FIG. 2, an open end of the cap (23*b*) is jointed to a cap receiving part (23*a*) of the rotatable cylinder (15), and the cap receiving part (23*a*) is positioned outside the jointing-part (22). At this time, a cap joint (23) is formed as a joint portion of the cap (23*b*) and the cap receiving part (23*a*), so as to become an enclosed space when the gas discharge port (24) is not open.

Under the state, the cap (23*b*) is connected to the body (3), so as to incorporate the jointing-part (22) and the jointed-part (22*b*) (See FIG. 2).

When removing once and reconnecting the gas supply channel (5), at first, only the cap (23*b*) and the cap receiving part (23*a*) are joined, and the jointing-part (22) and the jointed-part (22*b*) are not joined as shown in FIG. 2.

Under the state shown in FIG. 2, a gas supply from the gas supply channel (5) raises the pressure inside the cap joint (23), uplifts the film (23$b_2$) covering the cap body (23$b_1$), and opens the gas discharge port (24) (opens the valve) so as to outgas air and gas inside the cap joint (23) through the gas discharge port (24). A while later, air inside the cap joint (23) is completely outgassed. After the cap joint (23) is filled with gas, the jointing-part (22) and the jointed-part (22*b*) are jointed. This enables to prevent a slight amount of air in the jointing-part (22) from entering into the bottle together with gas via the gas injection channel (14*a*) when the gas supply channel (5) is reconnected.

In addition, the jointing-part (22) comprises a valve (not shown) for allowing gas to transfer only toward the gas injection channel (14). The valve (check valve) opens only when the jointed-part (22*b*) is jointed, which enables to prevent a back-flow and transfer gas to the gas injection channel (14).

The equipment of the cap joint (23) enables to remove the gas supply channel (5) once and easily perform the puncturing operation, and prevent a slight amount of air remaining in the jointing-part (22) from coming into the bottle through the gas injection channel (14) and the like when the gas supply channel (5) is reconnected.

Also, the jointing-part (22) and the cap joint (23) are connected to the rotatable cylinder (15) so as to be rotated at a predetermined angle in accordance with a rotation of the rotatable cylinder (15).

In addition, the beverage server system according to the first embodiment does not comprise a pressure relief mechanism for discharging gas inside the bottle to outside when the pressure inside the bottle exceeds a predetermined value, and therefore it is necessary to regulate an amount of gas provided from the gas supply channel (5) not to be excess.

A beverage server system comprising the pressure relief mechanism will be explained in the second embodiment.

However, even in the beverage server system according to the first embodiment, a small balloon-like object may be provided in a middle of the gas supply channel (5) as a basic pressure relief mechanism. An excess supply of gas from the gas supply channel (5) into the bottle leads to swell the balloon-like object, which results in reducing the amount of gas supply and the pressure inside the bottle. When the pressure inside the bottle rapidly rises before regulating the amount of gas supply, the balloon-like object swells and bursts so as to avoid a pressure rise inside the bottle.

In addition, in all of the embodiments (except the one shown in FIG. 5), the above-mentioned balloon-like object may be provided in the middle of the gas supply channel (5) as a basic pressure relief mechanism. Further, known decompression valves are preferably used and attached thereto, in place of the balloon-like basic pressure relief mechanism.

Figure 5:
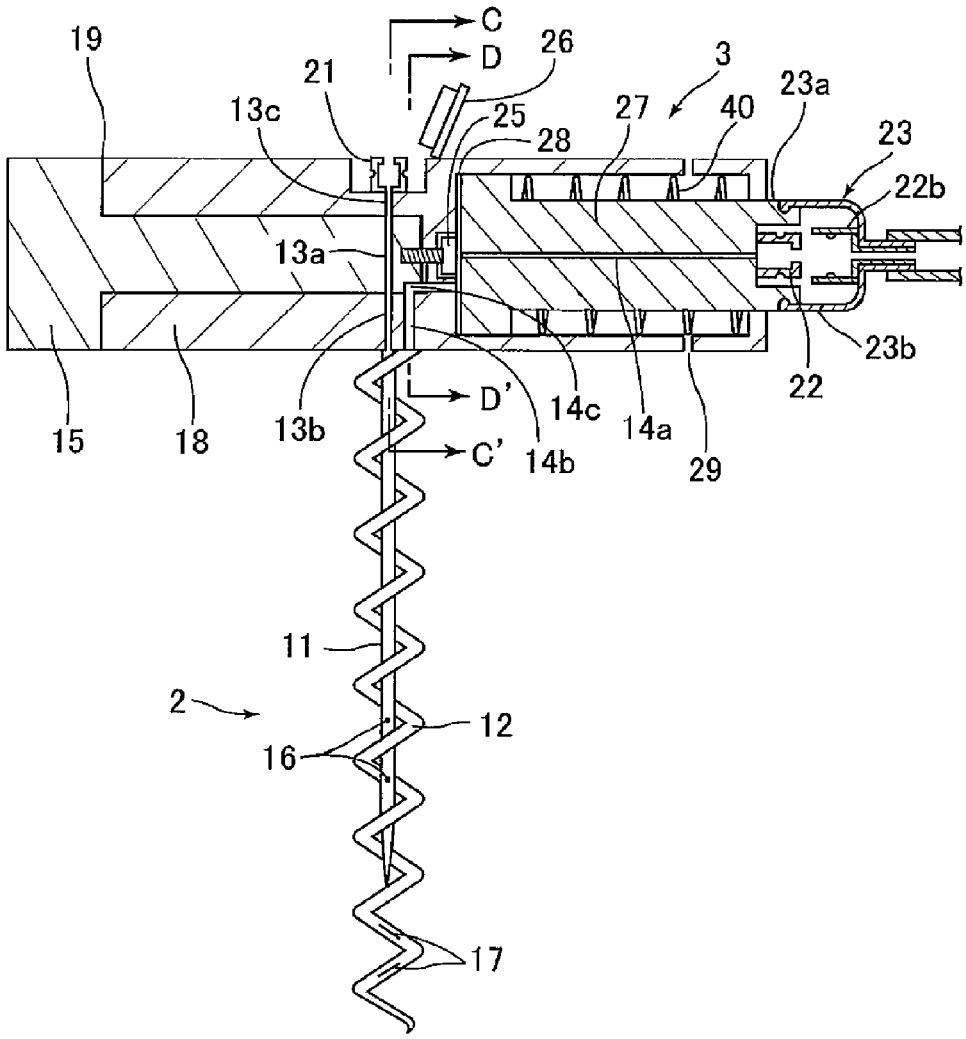
FIG. 5 is a cross-section view of an example of a body and a penetration element in a beverage server system of the second embodiment.

FIG. 5 is a cross-section view of an example of a body and a penetration element in a beverage server system of the second embodiment.

Figure 6:
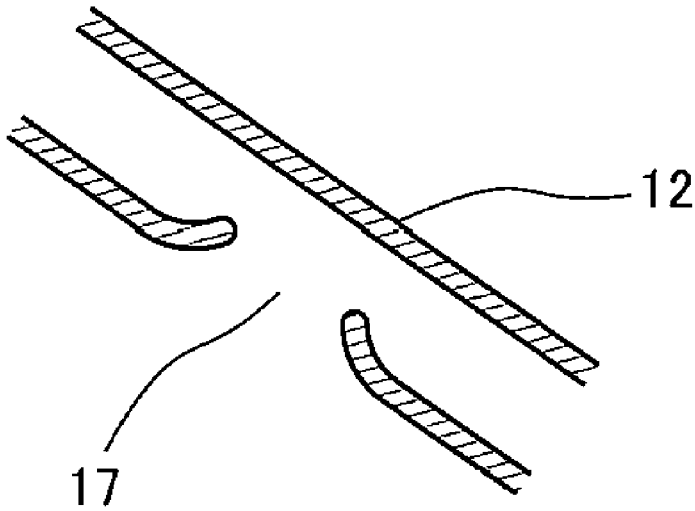
FIG. 6 is a partial cross-section view enlargely showing a gas injection part described in FIG. 5.

FIG. 6 is a partial cross-section view enlargely showing a gas injection port area described in FIG. 5.

Figure 7:
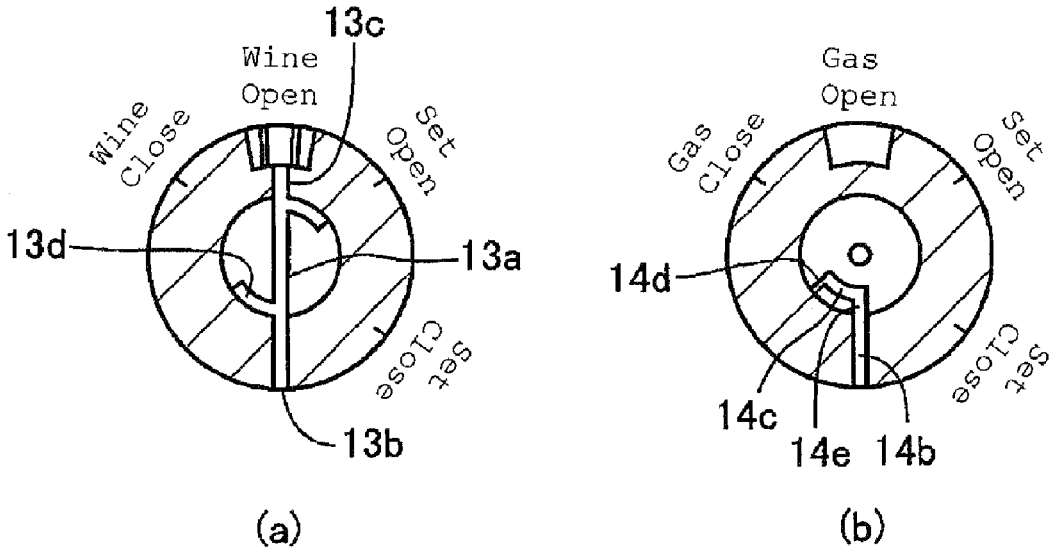
FIG. 7 (*a*) is a cross-section view taken from line C-C' of FIG. 5, and FIG. 7 (*b*) is a cross-section view taken from line D-D' of FIG. 5.

FIG. 7 (*a*) is a cross-section view taken from line C-C' of FIG. 5, and FIG. 7 (*b*) is a cross-section view taken from line D-D' of FIG. 5.

Figure 8:
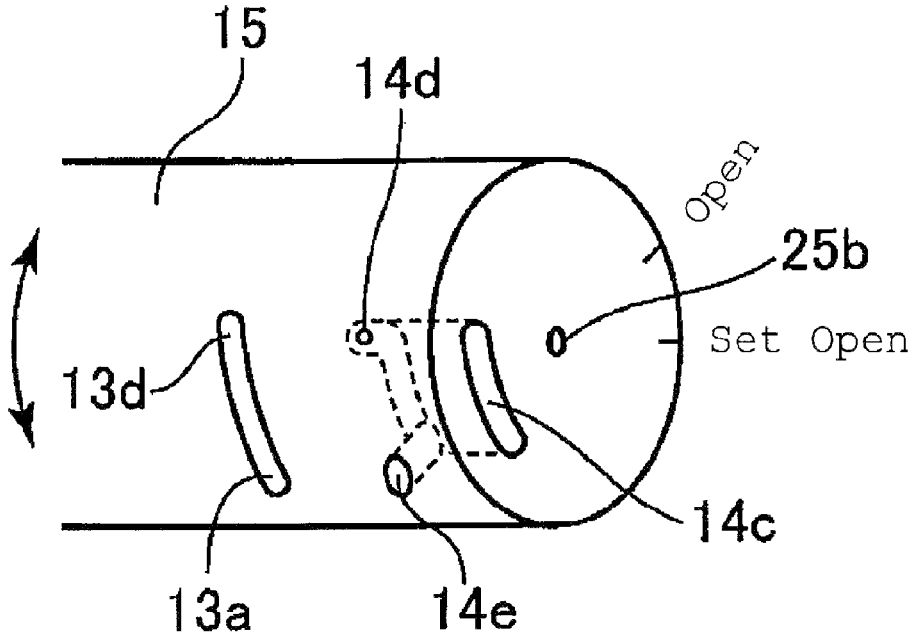
FIG. 8 is a perspective view of one end of a rotatable cylinder positioned at a middle of a body.

FIG. 8 is a perspective view of one end of a rotatable cylinder positioned around a middle of a body.

Figure 9:
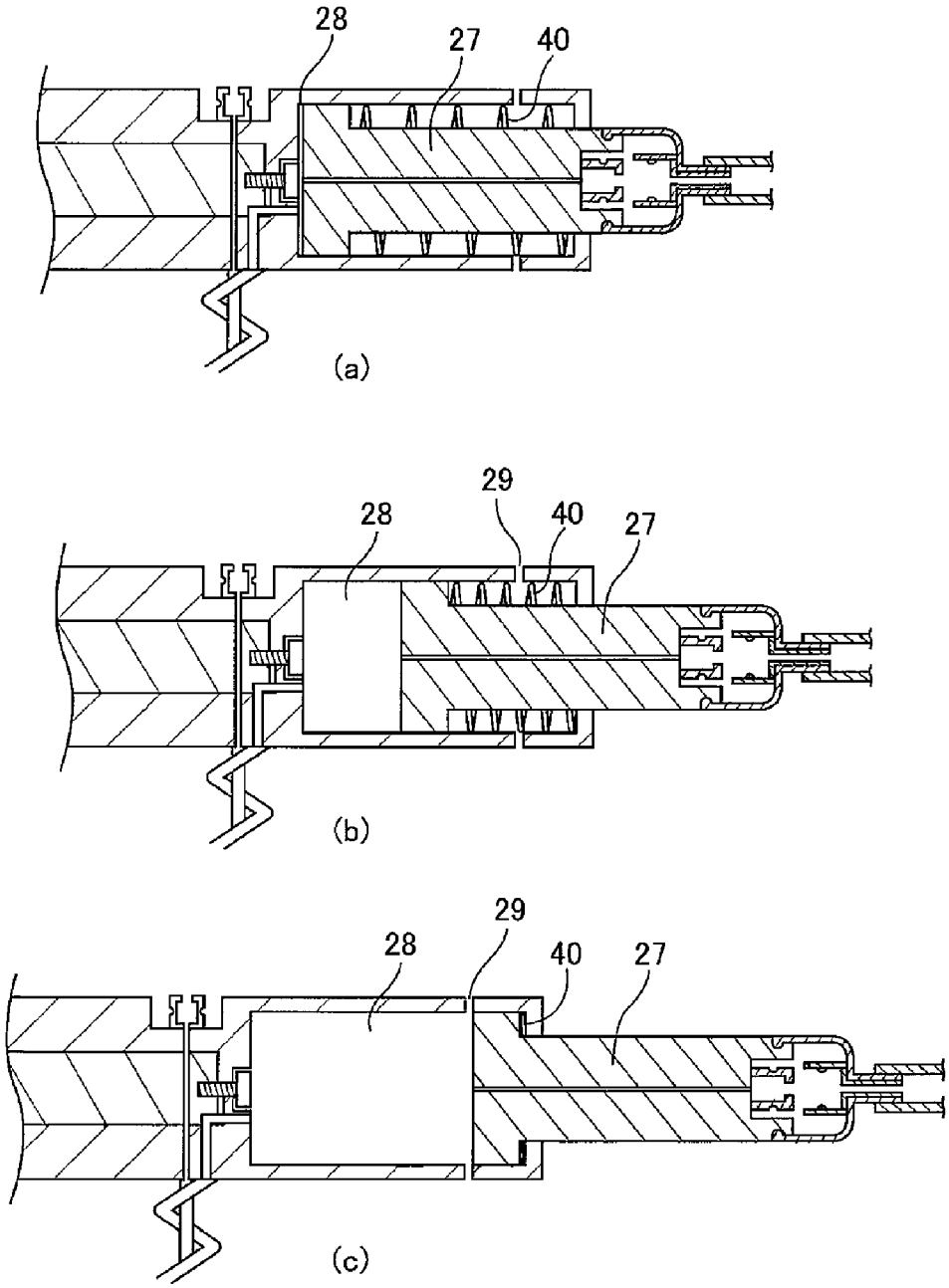
FIG. 9 is a cross-section view to show a state that a pressure relief cylinder shown in FIG. 5 moves to expand the gas reservoir.

FIG. 9 is a cross-section view to show a state that a pressure relief cylinder shown in FIG. 5 moves to expand the gas reservoir.

The beverage server system of the second embodiment comprises a penetration element (2) having a different shape from the one shown in the beverage server system of the first embodiment and also comprises a pressure relief cylinder (27) in a body (3). The pressure relief cylinder (27) is communicated with a gas injection channel (14) and functions as a pressure relief mechanism for discharging gas injected into a bottle to outside when the pressure inside the bottle exceeds a predetermined value.

The pressure relief cylinder (27) contracts a spring (40) and transfers (press-up) in order to form a gas reservoir (28) for reserving gas fed from the gas supply channel (5) (See FIG. 9). Further, the rotatable cylinder (15) has a slightly different structure from the one shown in the first embodiment.

The other structures of the second embodiment are the same as the ones of the first embodiment, and the same reference numbers are given to the same structures.

As the same as the first embodiment, the penetration element (2) has a beverage extraction conduit (11) for extracting wine inside the bottle and a gas injection conduit (12) for injecting gas into the bottle. The beverage extraction conduit (11) has a hollow and long needle shape, and wine (beverage)

passes therethrough. Gas passes through the gas injection conduit (12). However, in the second embodiment, the gas injection conduit (12) is spiral, and the beverage extraction conduit (11) is positioned at a center of the spiral.

A cork of the wine bottle has a diameter of about 18 mm so that it is preferable for the spiral gas injection conduit (12) to have a size capable of puncturing the cork in a range between more than about 3 mm from the perimeter (outer edge) of the cork and more than about 3 mm from the center of the cork. With such a structure, the cork portion to be pressed becomes relatively uniform on the cork surface, which results in preventing an intensive press against a partial portion of the cork and a gap formation in the punctured part. The spiral needle has a diameter of about 2-2.5 mm. Therefore, a diameter of the spiral is preferably about 8-14 mm, and more preferably about 10-12 mm. The long needle-shaped beverage extraction conduit (11) has a diameter of about 2-2.5 mm and is positioned at about 2 coils above of the outer spiral, i.e., about 30-40 mm shorter than a tip of the spiral. Therefore, the linear and long needle-shaped beverage extraction conduit (11) is able to enter into the cork by using a puncture force of the spiral gas injection conduit (12).

In addition, the beverage extraction conduit (11) and the gas injection conduit (12) are respectively made of a robust and rustless material, for example preferably stainless. In case a rust material is used, it is preferable to carefully perform a Teflon (registered trademark) coating thereon.

As the same as the first embodiment of the present invention, a beverage extraction port (16) is open at a tip of the hollow part of the beverage extraction conduit (11). A gas injection port (17) is open at a tip of the hollow part of the gas injection conduit (12) such that it penetrates through the cork and enters into the bottle prior to the beverage extraction port (16). That is, the gas injection port (17) is located closer to the tip side than the beverage extraction port (16).

In the present invention, the beverage extraction conduit (11) may be formed into a spiral shape, and the hollow and long needle-shaped gas injection conduit (12) may be positioned in a middle of the spiral. However, even in this case, the gas injection port (17) is located closer to the tip side than the beverage extraction port (16).

It is preferable for the gas injection port (17) to have an inwardly concaved shape at a circumference of an open part such that the cork powder does not get stuck therein when penetrating the cork as shown in FIG. 6. This also applies to the beverage extraction port (16).

As the same as the first embodiment, the body (3) comprises a beverage extraction channel (13), a gas injection channel (14) and a rotatable cylinder (15). The beverage extraction channel (13) and the gas injection channel (14) placed in the rotatable cylinder (15) also rotate in accordance with a rotation of the rotatable cylinder (15). However, because the gas injection channel (14) comprises a pressure relief cylinder (27) in the second embodiment, the gas injection channel (14*c*) inside the rotatable cylinder (15) is configured to be short, and the gas injection channel (14*a*) is provided also in the pressure relief cylinder (27).

Here, the rotatable cylinder (15) and the pressure relief cylinder (27) are able to be pulled out and removed from the body (3). This enables to easily and certainly wash an inner of the body (3). Because the rotatable cylinder (15) is fixed by means of a thread (25), a removal of the thread (25) allows to remove the rotatable cylinder (15).

In addition, a tip end of the body (3) at the pressure relief cylinder (27) side is configured to be removable (not shown), and a removal of this tip end allows to pull out and remove the pressure relief cylinder (27) from the body (3).

In the second embodiment, as a scale (19), a set-open position is set in addition to an open position and a close position at the rotatable cylinder (15) (See FIG. 7). At the set-open position, gas is configured to be transferred to the gas injection port (17) with a smaller amount than the one at the open position, and wine is configured to be extracted through the beverage extraction channel (13) with the same amount as the one at the open position.

Specifically, as shown in FIG. 7 (*b*) and FIG. 8, the gas injection channel (14*d*) at the set-open position is configured to be narrower than the gas injection channel (14*e*) at the open position. Therefore, under a state that gas is reserved in the gas reservoir (28) as shown in FIG. 9(*c*), it is possible to remove the gas supply channel (5) and easily puncture through the cork with the penetration element (2) while gas is slowly injected from the gas injection port (17), and prevent a back-flow of air via the gas injection port (17) when the gas supply channel (5) is removed once.

In addition, for example, a medical filter for a drip infusion may be inserted into the gas injection channel (14*a*), which enables to prevent the clogging especially at a narrow part such as the gas injection channel (14*e*).

On the other hand, although the beverage extraction channel (13*d*) at the set-open position is configured to be the same thickness as the beverage extraction channel (13*a*) at the open position as shown in FIG. 7 (*b*) and FIG. 8, an amount of the wine extracted from the beverage extraction channel (13*c*) is low because an amount of gas injected from the gas injection port (17) is low at the set-open position.

Further, a body (3) comprises a pressure relief hole (29) for releasing gas inside the gas reservoir (28). The rotatable cylinder (15) is set at the open position or the set-open position, and gas is fed from the gas supply channel (5) and supplied into the bottle via the gas injection port (17). Then, an excess supply of gas leads to press up the pressure relief cylinder (27) until a maximum position against a force of the spring (40) as shown in FIG. 9(*c*), and release gas from the pressure relief hole (29). This results in preventing gas pressure inside the bottle from being high. Because the wine bottle is not broken due to an inner pressure under about 2 atmospheric pressure (although this depends on the bottle), it is preferable to decide the setting such that the pressure relief cylinder (27) is pressed up and gas is released through the pressure relief hole (29) under 1.5 to 2 atmospheric pressure.

A lid (26) is mounted on a jointing-part (21) to which a beverage discharge channel (4) is removably connected. When the beverage discharge channel (4) is not connected, a closing of the lid (26) enables to prevent an entry of dust and grit through the jointing-part (21).

Next, an operation for extracting wine in the beverage server system of the second embodiment will be explained by being divided into (i) Deaeration (ii) Puncture to cork (iii) Wine Extraction (Gas Injection), and (iv) Aftertreatment.

(i) Deaeration

At first, the rotatable cylinder (15) is rotated to adjust the set-open position to the standard position at the grip (18). Then, the gas injection channel (14*a*) inside the pressure relief cylinder (27), the gas injection channels (14*c*, 14*d*) inside the rotatable cylinder (15), and the gas injection channel (14*b*) inside the grip (18) are communicated together (step 1).

Next, the jointed-part (22*b*) of the gas supply channel (5) is connected to the jointing-part (22) of the body (3), and gas is supplied therethrough. The narrow gas injection channel (14*d*) allows to clear out air inside the channel from the gas injection port (17) with a small amount of gas (step 2).

Under the state of step 2, even though the pressure relief cylinder (27) moves to reserve gas in the gas reservoir (28) once, the pressure relief cylinder (27) returns to the original position immediately because the supplied small amount of gas is cleared out from the gas injection port (17) and gas is not reserved in the gas reservoir (28). However, if there are clogs in the channel, the clogs raise the pressure inside the channel and transfer the pressure relief cylinder (27).

Here, after confirming that the pressure relief cylinder (27) is located at a home position as shown in FIG. 9 (*a*), the rotatable cylinder (15) is rotated to adjust the set-close position to the standard position at the grip (18) so as to close the gas channel inside the rotatable cylinder (15) (step 3).

Under the state that the gas channel inside the rotatable cylinder (15) is closed, gas is supplied. This raises gas pressure in the gas injection channel (14*a*) placed inside the pressure relief cylinder (27) and presses up the pressure relief cylinder (27) to reserve gas in the gas reservoir (28), which leads to reserve gas in the gas reservoir (28) until the pressure relief cylinder (27) is located at an over-flow position as shown in FIG. 9(*c*) (step 4).

When the pressure relief cylinder (27) moves until the over-flow position, the jointed-part (22*b*) of the gas supply channel (5) is removed from the jointing-part (22) of the body (3), and the cap (23*b*) of the gas supply channel (5) is also removed. Then, the gas supply channel (5) is removed from the body (3) (step 5).

(ii) Puncture to Cork

At first, only a middle part of a cap seal of the wine bottle is cut at a necessary size (for example, diameter 8-13 mm) for being punctured with the penetration element (2) (step 6). In this way, the cap seal is not completely removed, which enables to prevent a fallen cork and a dried cork. In addition, a jig to be preferably used for cutting only the middle part of the cap seal will be explained by referring to FIG. 25 later.

Next, the rotatable cylinder (15) is rotated to adjust the set-open position to the standard position, so as to communicate the gas channels and eject gas reserved in the gas reservoir (28) through the gas injection port (17) (Step 7).

While the gas which is reserved in the gas reservoir (28) is ejected from the gas injection port (17) over ten seconds, gas passes through the gas channel toward the gas injection port (17) and clears out air which has entered around the gas injection port (17) before the gas ejection. Thereafter, the penetration element (2) is rotated to puncture through the cork under the state that gas is still ejected from the gas injection port (17) (step 8).

When the gas injection port (17) completely enters into the cork, the cork is closely attached to the gas injection port (17) due to airtightness of the cork, which leads to lose a force of gas ejection (step 9).

Next, when the gas injection port (17) penetrates through the cork and enters into the bottle, gas is swiftly ejected from the gas injection port (17) again and raises pressure inside the bottle (step 10).

Next, the beverage extraction port (16) penetrates through the cork and enters into the bottle. Then, due to a risen atmosphere pressure inside the bottle and a gas pressure ejected from the gas injection port (17), a slight amount of air remaining around the beverage extraction port (16) is immediately passed through the beverage extraction conduit (11) and the beverage extraction channel (13) to be discharged to outside from the jointing-part (21) (step 11). This results in preventing contact of the slight amount of air remaining around the beverage extraction port (16) with wine, and avoiding a reflow of ambient air due to the above-mentioned check valve of the jointing-part (21).

Then, the rotatable cylinder (15) is adjusted to the close position, and the puncture to the cork with the penetration element (2) is completed (step 12).

(iii) Wine Extraction (Gas Injection)

The rotatable cylinder (15) is adjusted to the close position (or the set-close position) (step 13).

The cap (23*b*) of the gas supply channel (5) is mounted on the body (3), and a very slight amount of gas is supplied. This leads to lift up a film (23$b_2$) covering the cap (23*b*) and open a basic valve, and outgas air and gas inside a cap joint (23) (step 14).

Next, the jointed-part (22*b*) of the gas supply channel (5) inside the cap joint (23) is jointed to the jointing-part (22) of the body (3), and the reconnection of the gas supply channel (5) to the body (3) is completed (step 15).

Next, the lid (26) for covering the jointing-part (21) of the beverage extraction channel (13) is opened, and the beverage discharge channel (4) is connected to the jointing-part (21), and then the wine bottle is set on a wine rack (8) (step 16).

Next, a glass is set. The rotatable cylinder (15) is adjusted to the open position and gas is supplied for about 0.5 seconds, then wine is slowly poured into the glass through the beverage discharge channel (4) (step 17).

When a desired amount of wine is poured into the glass, the rotatable cylinder (15) is rotated and adjusted to the close position for stopping the discharge of wine (step 18). In addition, when it is required to add the wine a little more, a small amount of gas is supplied to pour out a small amount of wine.

(iv) Aftertreatment

In order to remove extra gas inside the bottle, the rotatable cylinder (15) is rotated and adjusted to the open position, and the beverage discharge channel (4) is removed. Then, with applying duster, glass or the like to the jointing-part (21), the wine bottle is uprighted once together with the penetration element (2) and the body (3).

If there is extra gas inside the bottle and the gas pressure is high, the gas is discharged from the jointing-part (21) together with wine remaining in the beverage supply channel (13). For example, when an amount of wine is below half, just an operation for returning the bottle on the level leads to discharge the wine remaining in the beverage supply channel (13).

It is preferable to certainly perform the described aftertreatment when the bottle is preserved for a few days or a high amount of gas exists in the bottle due to inexperienced handling. This is because wine is oozed out from a cork gap if the gas pressure inside the bottle is kept to be high. The aftertreatment may be omitted if the next wine extraction is carried out in a relatively early time, for example in 2 to 3 hours.

If there is space, it is convenient for a next extraction at restaurants requiring a large number of extractions to preserve the bottle together with a gas canister included in the wine rack with keeping the bottom of the wine rack being high in a wine storage or a fridge. It is also possible to lower the bottom of the wine rack to be compact, however, this requires to prepare a duster or the like because gas may be discharged from the jointing-part (21) when the bottle is uprighted once as described above.

Due to space or other reasons, it is possible to remove the gas supply channel (5) and the beverage discharge channel (4), and unload the wine bottle from the wine rack and preserve the wine bottle mounted with the penetration element (2) and the body (3). It is preferable to lay down the bottle for the preservation. In this case, the mounted equipment parts need to be treated carefully.

For the reconnection, the above-described (iii) Wine Extraction (Gas Injection) is performed.

As shown, according to the beverage server system of the second embodiment, it is possible to extract beverage from the beverage bottle with the simple structure without causing contact of the beverage inside the beverage bottle with air, and excels in easy operation for extracting the beverage, easy maintenance and easy introduction into household.

Figure 10:
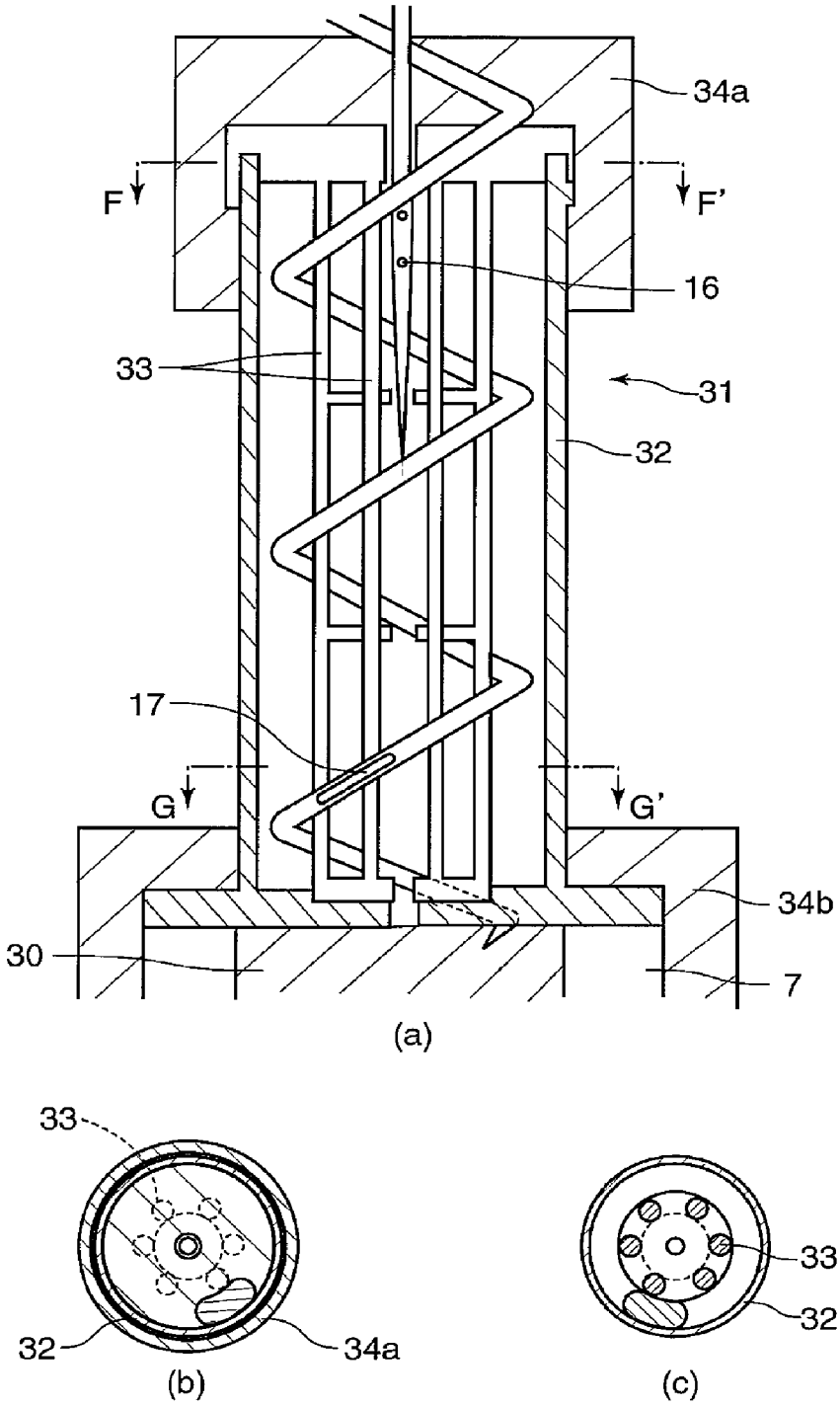
FIG. 10(*a*) is a pattern diagram to show an attachment of a guide equipment to a tip of the penetration element of the FIG. 5 so as to puncture the cork, (b) is a cross-section view taken from line F-F' of (a), and (c) is a cross-section view taken from line G-G' of (a).

FIG. 10(*a*) is a pattern diagram to show a state that a guide equipment is attached to the tip of the penetration element of the FIG. 5 in order to puncture through the cork, (b) is a cross-section view taken from line F-F' of (a), and (c) is a cross-section view taken from line G-G' of (a).

A guide equipment (31) has a cylindrical transparent or semitransparent frame (32) and 6 columns (33) positioned inside the frame (32) for supporting the penetration element (2). The columns (33) are held from above and below with top and bottom caps (34*a*, 34*b*) which both have an adhesion such as silicon, in order to keep airtightness inside the frame (32).

As for the above-described guide equipment (31), under a state of being attached to the tip of the penetration element (2), the bottom cap (34*b*) is fitted into the mouth of the wine bottle (7) so that only a more tip side portion than the gas injection port (17) of the gas injection conduit (12) stings the cork (30) as shown in FIG. 10(*a*). Under the state, the gas supply channel (5) is connected to the body (3), and a small amount of gas is ejected from the gas injection port (17). This leads to fill the frame (32) with gas, and the gas passes from the beverage extraction port (16) through the beverage extraction conduit (11) and the beverage extraction channel (13) and outgasses from the jointing-part (21). The jointing-part (21) has the valve as described above, which enables to prevent an entry of outside air.

While gas is filled in the frame (32), a removal of the gas supply channel (5) stops an outflow of gas from the beverage extraction port (16). This allows to operate the puncture without time restriction under the state that gas is filled in the frame (32). Accordingly, when the guide equipment (32) is mounted, it is not necessary to comprise the above-mentioned pressure relief cylinder (27) and the above-mentioned gas reservoir (28).

According to the guide equipment (31) comprising the frame (32), the column (33) and the bottom cap (34*b*), the puncture operation to the cork (30) with the spiral penetration element (2), which is difficult for ordinary people to do it in a straight line, can be carried out easily.

The guide equipment (31) may be used for all the first to the third embodiments.

Figure 11:
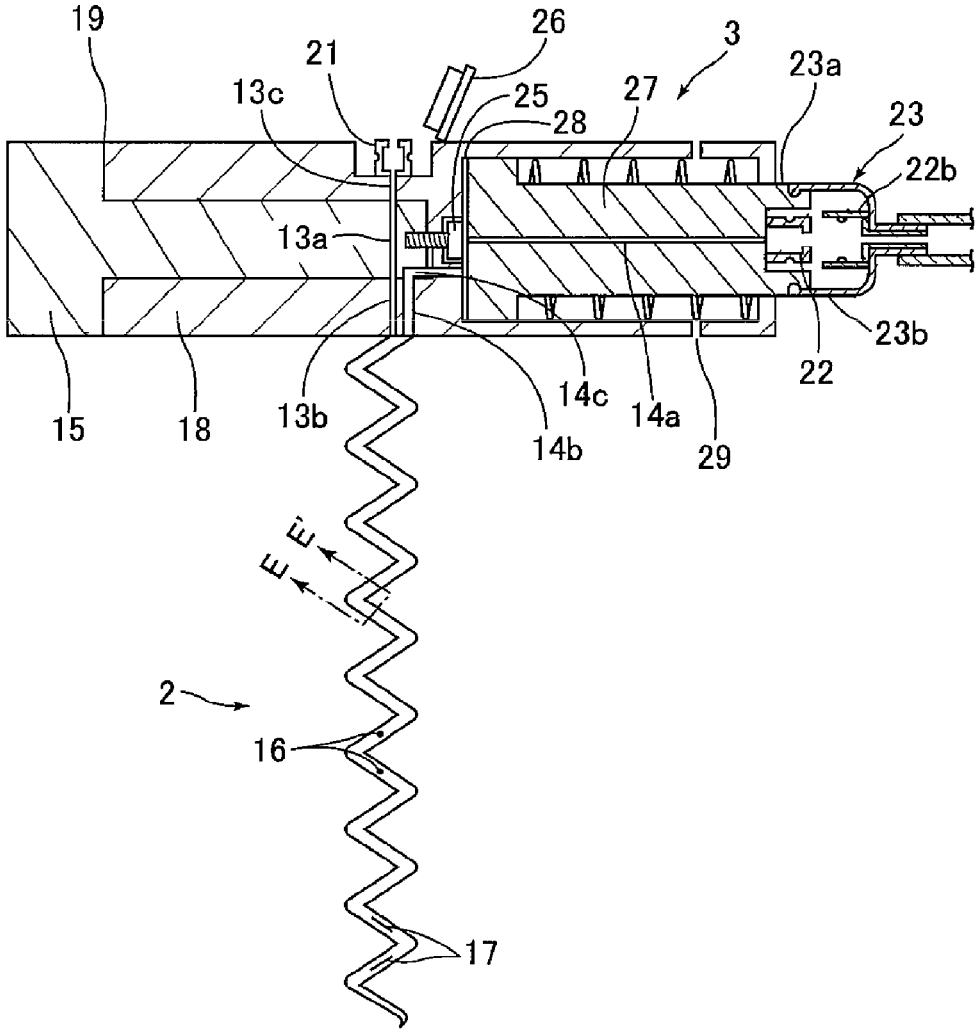
FIG. 11 is a cross-section view of one example of a body and a penetration element in a beverage server system according to the third embodiment.
Figure 12:
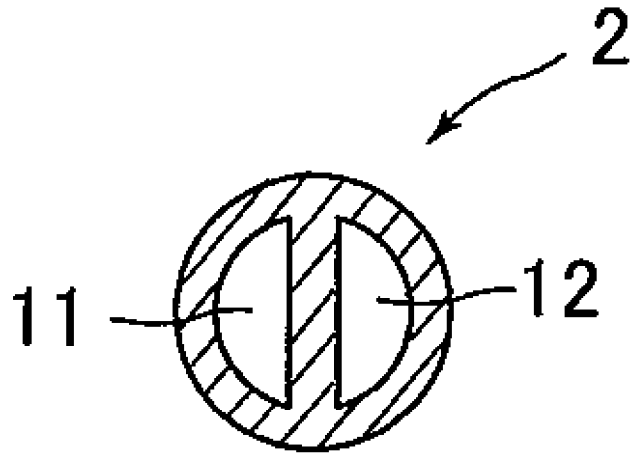
FIG. 12 is a cross-section view taken from line E-E' of the penetration element in FIG. 11.

FIG. 11 is a cross-section view of one example of a body and a penetration element in a beverage server system according to the third embodiment. FIG. 12 is a cross-section view taken from line E-E' of the penetration element in FIG. 11.

The beverage server system of the third embodiment comprises a penetration element (2) having a different shape from the one shown in the beverage server system of the second embodiment, and the rest of the structures are exactly the same as the ones shown in the second embodiment.

A penetration element (2) of the third embodiment is a single spiral needle, and an inner of the single needle is divided into a beverage extraction conduit (11) and a gas injection conduit (12) as shown in FIG. 12. On a tip of the penetration element (2), a beverage extraction port (16) is provided at a tip of the beverage extraction conduit (11), and a gas injection port (17) is provided at a more tip side of the gas injection conduit (12) than the beverage extraction port (16). That is, the gas injection port (17) is placed closer to the tip side than the beverage extraction port (16).

Accordingly, as the same as the first embodiment and the second embodiment, the gas injection port (17) enters into the bottle prior to the beverage extraction port (16) when the penetration element (2) punctures and penetrates through the cork. After the gas pressure rises, the beverage extraction port (16) enters into the bottle. Then, gaseous matter originally existing inside an upper part of the bottle pushes out air inside the beverage extraction port (16) due to the gas pressure. Therefore, air inside the beverage extraction port (16) is difficult to enter into the bottle.

Further, in the third embodiment, the penetration element (2) formed into the single spiral enables to easily penetrate the cork, and it is not necessary to limit a diameter of the spiral and a diameter of the needle of the spiral as described in the second embodiment.

As shown, except for the penetration element (2) formed into the single spiral in order to easily and rapidly perform the puncture, the third embodiment has the same structures as the second embodiment. Therefore, except it is possible to easily and rapidly puncture the cork with the penetration element (2), the extraction operation of the beverage server according to the third embodiment is the exactly same as the second embodiment, and enables to exhibit the same effect as the second embodiment.

Figure 13:
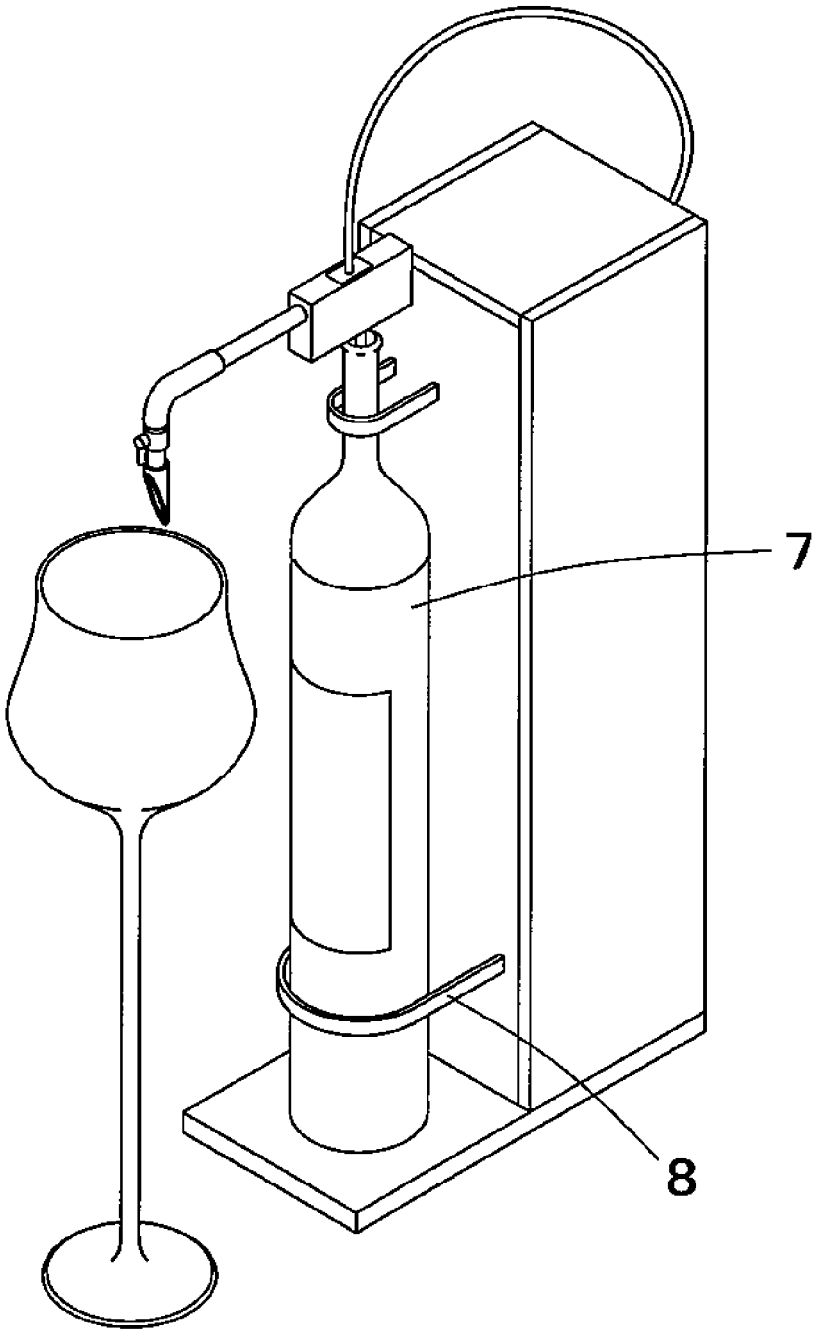
FIG. 13 is a perspective view to show a usage of a beverage server system according to the fourth embodiment.
Figure 14:
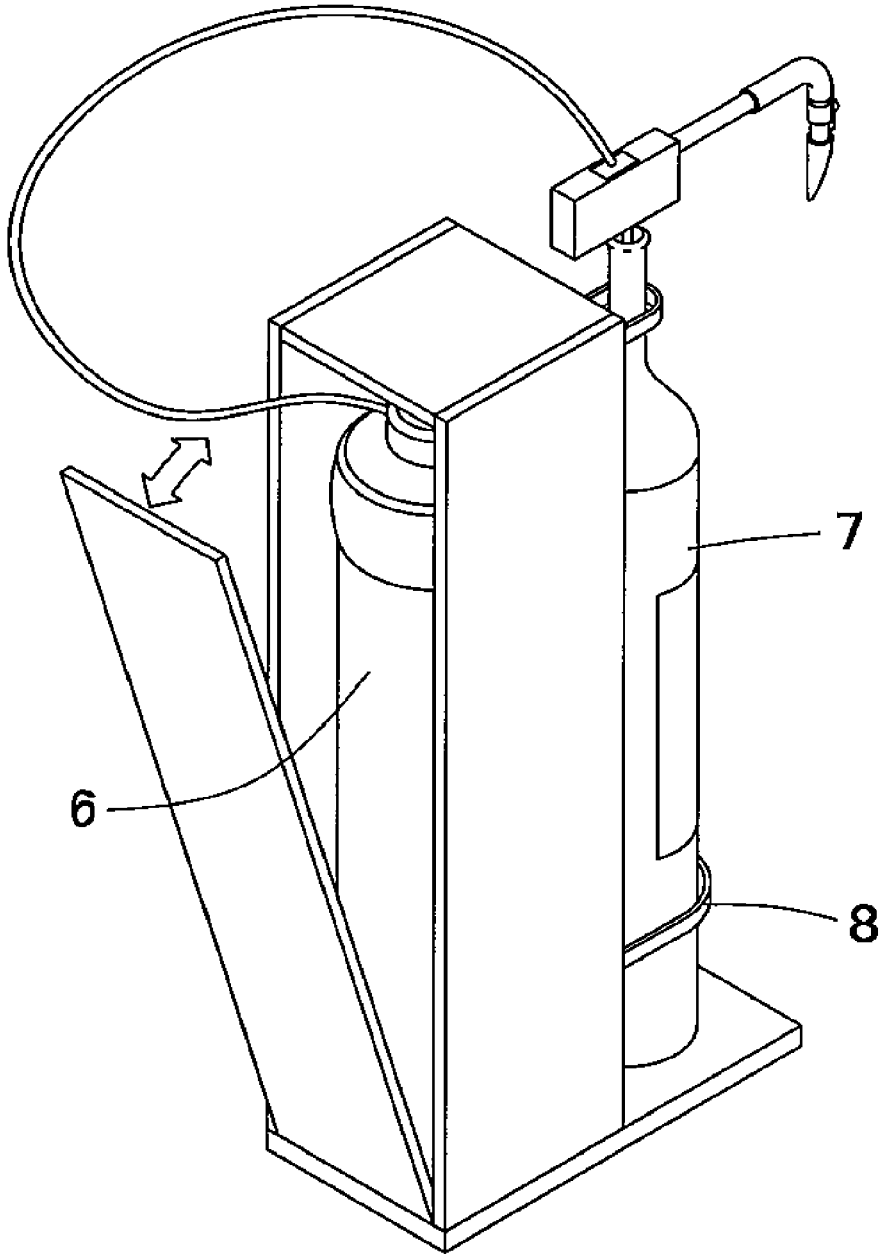
FIG. 14 is a rear view of FIG. 13.
Figure 15:
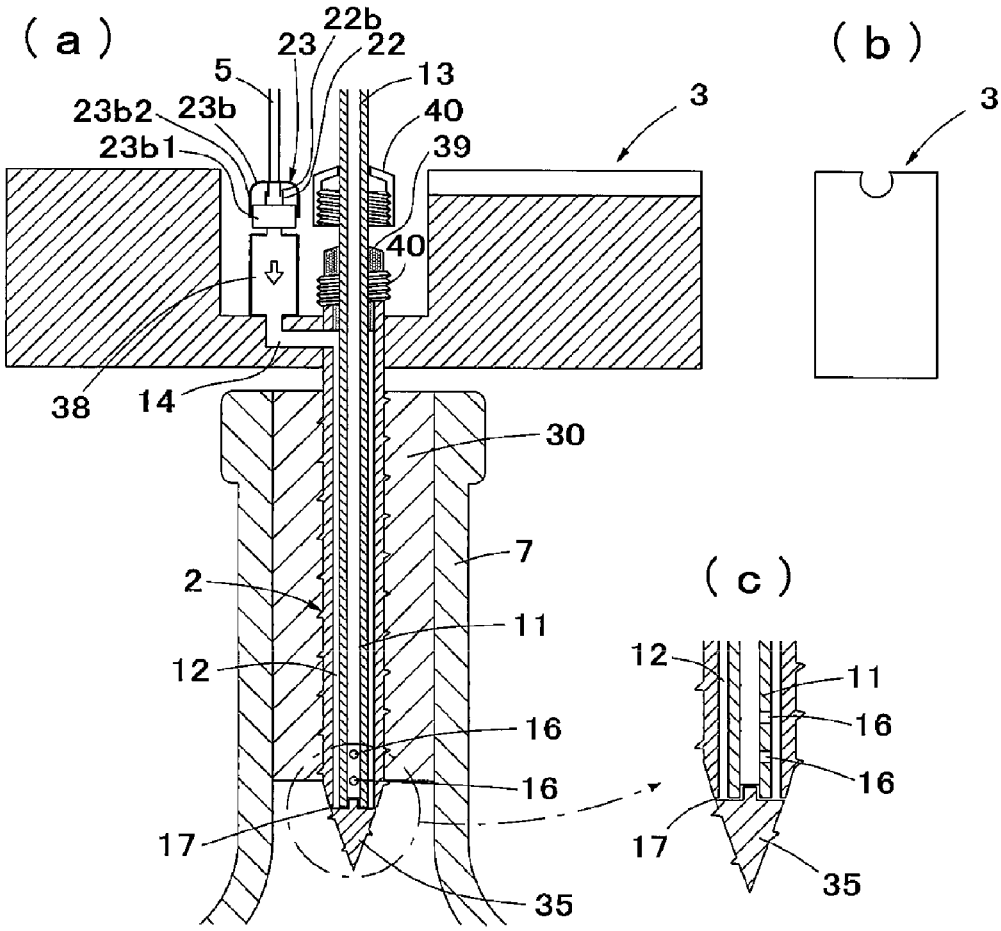
FIG. 15 is a view to show an example of a penetration element and a body of the beverage server system according to the fourth embodiment, and (a) is a front cross-section view, (b) is a side view of the body, and (c) is an enlarged view in which a beverage extraction conduit shown in (a) is rotated at 90 degrees.
Figure 16:
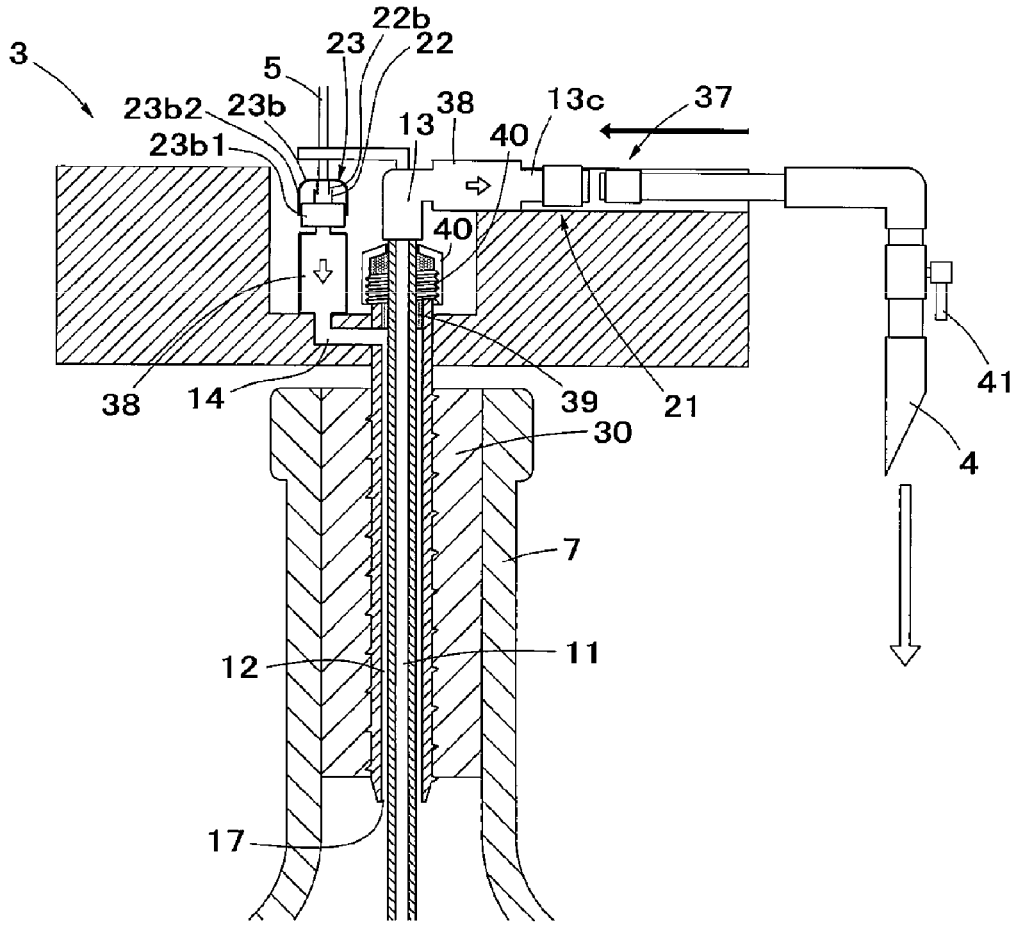
FIG. 16 is a cross-section view to show a usage state of a penetration element and a body of the beverage server system according to the fourth embodiment.

FIG. 13 is an anterior perspective view of a beverage server system according to the fourth embodiment, and shows a usage state that a wine bottle is set on a front surface of a wine rack made of a wooden box, and the wine bottle is uprighted. FIG. 14 is a rear perspective view of the beverage server system according to the fourth embodiment, and shows a state that a gas canister is received inside the wooden box. FIG. 15 is a view to show an example of a body and a penetration element of the beverage server system according to the fourth embodiment. FIG. 16 shows a state to downwardly move a beverage extraction conduit of the beverage server system shown in FIG. 15 and discharge a beverage such as wine from a beverage extraction port.

A different point of a beverage server system according to the fourth embodiment from the ones of the first to the third embodiments is that a beverage extraction conduit (11) is incorporated into a gas injection conduit (12) and movable along the gas injection conduit (12). That is, the beverage extraction conduit (11) and the gas injection conduit (12) have a double tube structure, wherein the former is an inner tube and the latter is an outer tube. Further, the beverage extraction conduit (11) moves so as to change its protrusive amount from a tip of the gas injection conduit (12).

According to the other structures of the fourth embodiment, the same structures as the first to the third embodiments have the same reference numbers.

As shown in FIGS. 13 and 14, the beverage server system of the fourth embodiment enables to serve wine by keeping a bottle (7) in an upright position without tilting, which is different from the first to the third embodiments.

This enables to prevent lees of wine existing in a bottom of the bottle (7) from stirring up, and serve wine by keeping the bottle in a wine cooler.

FIG. 15 shows one example of a penetration element and a body of a beverage server system according to the fourth embodiment, (a) is a front cross-section view, (b) is a side view of the body (3), and (c) is an enlarged view in which a beverage extraction conduit (11) of (a) is rotated at 90 degrees.

As shown in FIG. 15, a penetration element (2) has a beverage extraction conduit (11) for extracting wine inside a bottle and a gas injection conduit (12) for injecting gas into the bottle, which is the same as the first to the third embodiments.

However, in the fourth embodiment, the gas injection conduit (12) is a hollow and long male thread having a thread on its outer circumference surface. The beverage extraction conduit (11) is a hollow stick. The beverage extraction conduit (11) is incorporated into a hollow part of the gas injection conduit (12) with a predetermined space therearound, and is removable in a vertical direction (up and down direction).

A tip end (35) positioned at a lower part of the beverage extraction conduit (11) is conical, and its maximum diameter is larger than the one of the hollow part of the gas injection conduit (12). Therefore, the tip end (35) of the beverage extraction conduit (11) is configured not to enter into the hollow part of the gas injection conduit (12).

Also, as shown in figure, a thread is preferably formed on an outer circumference surface of the tip end (35) of the beverage extraction conduit (11) as the same as the gas injection conduit (12). The formed-thread allows the tip end (35) of the beverage extraction conduit (11) to easily enter into the cork (30).

In addition, the beverage extraction conduit (11) and the gas injection conduit (12) are both preferably made of a robust and rustless material, for example, stainless. In case a rust material is used, it is preferable to carefully perform a Teflon (registered trademark) coating thereon.

Under a state that the penetration element (2) is punctured through the cork (30), an elasticity of the cork (30) provides airtightness between the cork (30) and the penetration element (2), and therefore prevents air from coming into the bottle through the punctured part.

Especially, the penetration element (2) having the double tube structure and the thread on its outer circumference surface leads to enlarge an outer diameter of the penetration element (2) and increase the elasticity receiving from the cork (30), which results in providing very high airtightness. This is the same as the fifth to seventh embodiments to be described below.

Plural beverage extraction ports (16) communicated with the hollow part are opened at a lower side surface of the beverage extraction conduit (11). Also, a gas injection port (17) is provided between a lowest end of the gas injection conduit (12) and a top surface of the tip end (35) of the beverage extraction conduit (11) so as to penetrate through the cork and enter into the bottle prior to the beverage extraction port (16).

Under a state that the beverage extraction conduit (11) is completely incorporated into the gas injection conduit (12) (FIG. 15), the beverage extraction port (16) is located above the gas injection port (17). Under the state, the beverage extraction port (16) is covered with an outer envelope part of the gas injection conduit (12), so that it does not operate at all.

The lowest end of the gas injection conduit (12) and the top surface of the top part (35) of the beverage extraction conduit (11) are firmly attached when punctured into the cork (30). Under the state, the gas injection port (17) is not open. A lowering of the beverage extraction conduit (11) leads to open the gas injection port (17).

The gas injection port (17) is blocked with the tip end (35) of the beverage extraction conduit (11) when puncturing the cork (30) with the penetration element (2), which enables to prevent powder of the cork (30) from clogging into the gas injection port (17).

The beverage extraction port (16) is covered with the outer envelope part of the gas injection conduit (12) when puncturing the cork (30) with the penetration element (2), which enables to prevent powder of the cork (30) from clogging into the beverage extraction port (16).

As shown in FIG. 16, the body (3) has a beverage extraction conduit (13) and a gas injection conduit (14). However, in the present invention, as described later in the fifth and sixth embodiments, the beverage extraction conduit (11) may be configured to linearly penetrate through the body (3) so as to double as a beverage extraction conduit (13). That is, the beverage extraction conduit (13) comprised in the body (3) may be consisted of a single tube which is the same as the beverage extraction conduit (11).

A beverage discharge channel (4) is removably connected to the beverage extraction channel (13*c*) (a black arrow in FIG. 16 shows a direction for the mounting), and a gas supply channel (5) is removably attached to a gas injection channel (14).

The beverage discharge channel (4) has a jointed-part (37) at its tip, and the jointed-part (37) is fitted and connected to a jointing-part (21) provided at a tip of the beverage extraction channel (13*c*). As for the jointing-part (21), for example, a plug or socket for connecting gas pipes may be used. In addition, the jointing-part (21) has a check valve (38) which opens due to pressure from the beverage extraction channel (13) but does not open due to high pressure of the outside, which allows to prevent air from coming into the beverage extraction channel (13).

In addition, the beverage discharge channel (4) can be opened and closed by operating a lever (41).

The beverage extraction channel (13*c*) is connected to the beverage extraction conduit (11) by a pair of packing (40) consisting of a male thread and a female thread via a silicon packing (39), which results in enhancing airtightness.

The gas injection channel (14) is communicated with the gas injection conduit (12) and it comprises a jointing-part (22) at its tip via the check valve (38) which opens due to pressure at the gas supply channel (5) but does not open due to high pressure at the gas injection channel (14).

A jointed-part (22*b*) to be jointed to the jointing-part (22) is provided at a tip of the gas supply channel (5), and the jointing-part (22) and the jointed-part (22*b*) are jointed to lead a connection of the gas supply channel (5) and the gas injection channel (14) as shown in FIG. 16.

The gas supply channel (5) comprises an air contamination prevention mechanism at its tip, which allows to be mounted on the jointing-part (22) without causing air contamination to the gas injection channel (14) as the same as the one in the first embodiment. Specifically, a cap joint (23) provided at a joint portion of the gas supply channel (5) and the gas injection channel (14) is utilized to prevent air contamination.

Based on FIG. 17, the contamination prevention mechanism will be explained in detail.

The air contamination prevention mechanism comprises the jointed-part (22*b*) to be jointed to the jointing-part (22) disposed on the tip of the gas injection channel (14), and a cap (23*b*) covering an outer circumference of the jointed-part (22*b*).

The cap (23*b*) comprises a cap body ($\mathbf{23}b_1$) having an umbrella shape and consisting of an elastic body such as transparent rubber, and a cylindrical cover ($\mathbf{23}b_2$) for covering a tube surface at an upper part of the cap body ($\mathbf{23}b_1$).

The cap body ($\mathbf{23}b_1$) has a gas discharge port (24). The gas discharge port (24) is blocked with the cover ($\mathbf{23}b_2$) in normal time, and it opens when the cover ($\mathbf{23}b_2$) is uplifted due to high pressure inside the cap body ($\mathbf{23}b_1$). That is, the gas discharge port (24) and the cover ($\mathbf{23}b_2$) work as a basic valve.

The cap joint (23) is formed by a joint of an open end of the cap (23*b*) and a cap receiving part (23*a*), so as to become an enclosed space when the gas discharge port (24) is not open.

Under the state, the cap (23*b*) is connected to the body (3) such that it incorporates the jointing-part (22) and the jointed-part (22*b*) therein.

Figure 17:
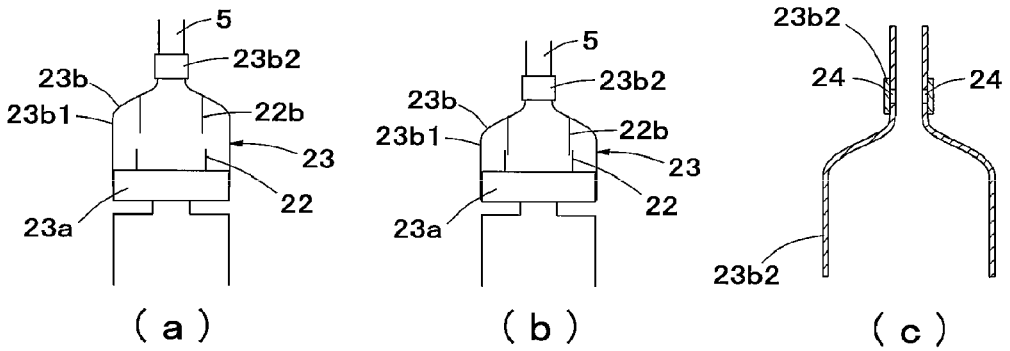
FIG. 17 shows a cap joint, and (a) shows a state that the jointing-part and the jointed-part are not jointed, (b) shows a state that the jointing-part and the jointed-part are jointed, and (c) is an enlarged cross-section view of the cap body to show a gas discharge hole.

FIG. 17(*a*) shows a state that the jointing-part (22) and the jointed-part (22*b*) of the cap joint (23) are not jointed, FIG. 17(*b*) shows a state that the jointing-part (22) and the jointed-part (22*b*) are jointed, and FIG. 17(*c*) is an enlarged cross-section view of the cap body (23$b_2$) in order to show a gas discharge hole (24).

Hereinafter, an air contamination prevention method will be explained, utilizing the air contamination prevention mechanism comprising the above structures.

At first, as shown in FIG. 17(*a*), only the cap receiving part (23*a*) and the cap body (23$b_1$) are joined. At this moment, the cap joint (23) includes air therein, and the jointing-part (22) and the jointed-part (22*b*) are not connected. Then, under the state, gas is supplied from the gas supply channel (5).

Then, a gas pressure inside the cap joint (23) rises, and slightly enlarges a cylindrical rubber constituting the cover (23$b_2$) and discharges gas and air inside the cap joint (23) through the gas discharge port (24) provided at an upper stream of the cap (23*b*).

After that, the jointing-part (22) and the jointed-part (22*b*) are jointed as shown in FIG. 17(*b*), and only gas with no air is supplied from the gas supply channel (5) toward the gas injection channel (14).

The jointing-part (22) is configured to open only when jointed to the jointed-part (22*b*) and transfer gas and the like toward the gas injection channel (14). Specifically, the jointing-part (22) and the jointed-part (22*b*) may be comprised of a socket and a plug of a coupling (for example, Coupler (Registered Trademark) made by Nitto Kohki co. Ltd.). In the fifth to the seventh embodiments to be explained later (See FIG. 18 etc.), the jointing-part (22) and the jointed-part (22*b*) are described with a more specific coupler appearance.

The equipment of the cap joint (23) as described above enables to prevent air contamination when mounting the gas supply channel (5) on the gas injection channel (14). Therefore, it is possible to remove the cap joint (23) once such that the gas supply channel (5) does not tangle when rotating the penetration element (2) to puncture the cork (30). This leads to easily operate the puncture and prevent a slight amount of air remaining in the jointing-part (22) from coming into the bottle via the gas injection channel (14) and the like when reconnecting the gas supply channel (5).

Further, due to the equipment of the cap joint (23), a removal of the cap joint (23) enables to place only the bottle (7) equipped with the penetration element (2) and the body (3) in a fridge and store it easily.

When gas inside the gas canister (6) runs out and the gas canister (6) needs to be exchanged, the cap joint (23) enables to purge air inside the gas supply channel (5) which has connected to a new gas canister (6).

Next, an operation for extracting wine according to the beverage server system of the fourth embodiment will be explained by being divided into (i) Puncture to cork, (ii) Wine Extraction (Gas Injection), and (iii) Aftertreatment.

(i) Puncture to Cork

Only a middle part of a cap seal of the wine bottle is cut at a necessary size (for example, diameter 8-13 mm) for being punctured with the penetration element (2) (step 1). In this way, the cap seal is not completely removed, which enables to prevent a fallen cork and a dried cork.

The tip end (35) of the penetration element (2) is applied to the cork (30), and slightly punctures not to penetrate completely (step 2).

Under the state, gas is supplied from the gas canister (6) through the gas injection conduit (12). Then, because of a firm attachment of the lowest end of the hollow part of the gas injection conduit (12) and the top surface of the tip end (35) of the beverage extraction conduit (11), gas passes from the gas injection conduit (12) through the beverage extraction port (16) and the beverage extraction conduit (11) and discharges from the beverage extraction channel (13*c*). Accordingly, it is possible to purge air not only inside the gas injection conduit (12) but also inside the beverage extraction conduit (11) and the beverage extraction channel (13) (step 3). The above-mentioned check valve (38) of the jointing-part (21) enables to prevent a reflow of outside air.

The penetration element (2) of the fourth embodiment does not comprise a gas reservoir (28) as shown in the second and the third embodiments, which enables to purge air with a slight amount of gas.

Next, the cap body (23$b_1$) and the cap receiving part (23*a*) are removed and the jointing-part (22) and the jointed-part (22*b*) are removed (step 4). Here, the above-mentioned jointing-part (22) is configured to open only when jointed to the jointed-part (22*b*). Further, due to the check valve (38), a back-flow of gas and a flow-in of air do not occur.

After that, the penetration element (2) is rotated to further puncture through the cork (step 5). At this moment, the cap joint (23) is not connected, i.e., the gas supply channel (5) is separated from the body (3) so as not to cling with the body (3).

Next, a part in which the gas injection port (17) is formed (the bottom end of the gas injection conduit (12)) is penetrated through the cork (30) and entered inside such that it does not reach to wine (step 6) (See FIG. 15).

The gas injection conduit (12) is not allowed to lower more than this position. Accordingly, the gas injection port (17) does not reach to the wine, which is different from the first to the third embodiments. This results in not generating a bubble of gas inside the wine and in preventing lees of the wine from stirring up.

Next, the beverage extraction conduit (11) is moved downward in a vertical direction toward wine inside the bottle (7) along the gas injection conduit (12) and lowered until the beverage extraction port (16) reaches to wine inside the bottle (7), specifically, until a bottom end of the beverage extraction conduit (11) reaches to the bottom of the bottle (step 7). At this time, because the beverage extraction port (16) is located slightly upper (a few millimeters) than the bottom end of the beverage extraction conduit (11), lees remaining in the bottle bottom are not absorbed from the beverage extraction port. However, when an amount of lees is high, the lowering operation of the beverage extraction conduit (11) may be stopped slightly above the bottle bottom. Generally, it does not cause problems in most cases to lower the beverage extraction conduit (11) until its bottom end reaches to the bottle bottom because the bottom of the wine bottle has a convex shape in a middle part.

Here, the packing (40) is fastened to prevent gas from leaking through the upper end of the gas injection conduit (12) when gas pressure inside the bottle (7) rises resulting from a gas injection operation (this will be explained later) (step 8).

ii) Wine Extraction (Gas Injection)

The jointing-part (21) and the jointed-part (37) are jointed to mount the beverage discharge channel (4) on the body (3) (step 9).

The bottle (7) is set on the wine rack (8) formed on a front surface of a wooden box (Step 10) (See FIG. 13).

Only the cap receiving part (23*a*) and the cap body (23$b_1$) are joined, and a slight amount of gas is supplied from the gas supply channel (5). This raises gas pressure inside the cap joint (23) and slightly enlarges the rubber cover (23$b_2$), and discharge gas and air inside the cap joint (23) through a tiny gas discharge hole (24) provided in the cap body (23$b_1$) (Step 11). After gas and air is discharged, the cover (23$b_2$) is closely attached to the gas discharge hole (24) due to its own resilience.

Next, the jointed-part (22*b*) of the gas supply channel (5) inside the cap joint (23) is jointed to the jointing-part (22) of the body (3), and the connection of the gas supply channel (5) to the body (3) is completed (Step 12).

Next, a glass is set. After opening the lever (41), gas is transferred from the gas canister (6) so as to raise gas pressure inside the bottle (7). Then, gas presses a liquid surface of wine, and therefore wine enters through the beverage extraction port (16) and passes through the beverage extraction conduit (11) to be slowly poured into the glass from the beverage discharge channel (4) (step 13) (See FIG. 16).

In addition, when it is required to add the wine a little more, a small amount of gas is supplied so as to extract a small amount of wine. When the wine reaches to a desired amount, the lever (41) is closed.

(iii) Aftertreatment

The wine bottle with the remaining wine can be preserved by keeping the upright posture for about several months, and aftertreatments such as an outgassing operation are not required.

Due to space or other reasons, it is possible to remove the gas supply channel (5) and the beverage discharge channel (4) and unload the wine bottle from the wine rack and preserve the wine bottle mounted with the penetration element (2) and body (3).

Compared to the first to the third embodiments, the above-described beverage server system of the fourth embodiment is able to efficiently extract a beverage from the beverage bottle with the more simple structure without causing contact of the beverage inside the beverage bottle with air, and excels in easy operation for extracting the beverage, easy maintenance and easy introduction into household.

More specifically, the beverage server system of the fourth embodiment enables to serve wine by keeping the upright posture without tilting the bottle (7), which is different from the first to the third embodiments.

Therefore, it is possible to prevent a stir-up of lees existing in wine at the bottom of the bottle (7) and also serve wine by being kept in a wine cooler. Further, different from the first to the third embodiments, a gas bubble does not occur in the wine because the gas injection conduit (12) does not contact with wine, which results in preventing the stir-up of lees in wine and certainly preventing lees from being extracted together with wine.

In addition, the gas injection port (17) is blocked with the tip end (35) of the beverage extraction conduit (11) when puncturing through the cork (30) with the penetration element (2), which results in preventing the powder of the cork (30) from clogging into the gas injection port (17).

Further, the beverage extraction port (16) is covered with the gas injection conduit (12) when puncturing through the cork (30) with the penetration element (2), which results in preventing the powder of the cork (30) from clogging into the beverage extraction port (16).

Figure 18:
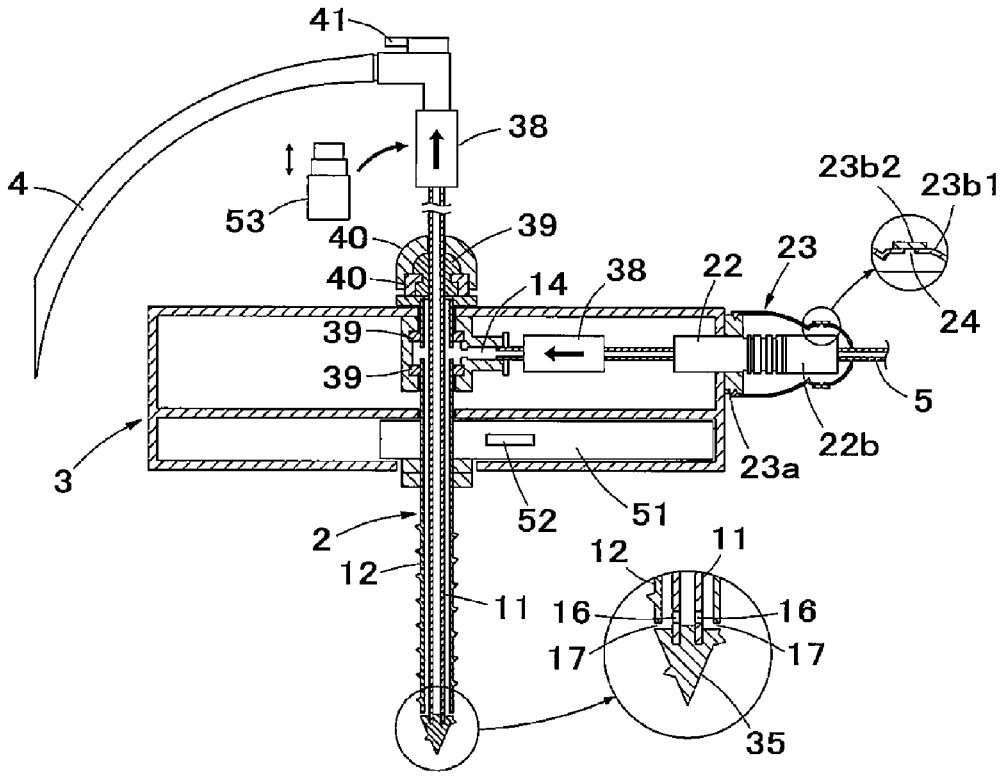
FIG. 18 is a front cross-section view of a penetration element and a body of a beverage server system according to the fifth embodiment.

FIG. 18 is a front cross-section view of a penetration element and a body of a beverage server system according to the fifth embodiment.

A beverage server system according to the fifth embodiment has many structures common to the above-described fourth embodiment. In order to avoid repeating descriptions, the same reference numbers are given to the same structures and their explanations are omitted. However, even the same structures may be shown with different shapes and positioned in the fourth embodiment and the fifth embodiment.

The beverage server system of the fifth embodiment comprises a ratchet mechanism in a body (3).

The ratchet mechanism (51) is incorporated into the body (3) and it rotates a penetration element (2) in the same direction when rotating the body (3) in one direction (right direction), while it does not rotate the penetration element (2) when rotating the body (3) in a reverse direction (left direction) of the one direction This enables to very easily operate a puncture of a cork with the penetration element (2)

The ratchet mechanism (51) comprises a rotation switching operation part (52).

The operation of the rotation switching operation part (52) allows to rotate the penetration element (2) in the same direction when rotating the body (3) in the left direction, and not to rotate the penetration element (2) when rotating the body (3) in the right direction.

The equipment of the rotation switching operation part (52) enables to easily pull out the penetration element from the cork.

An operation for extracting wine in the beverage server system of the fifth embodiment is the same as the fourth embodiment.

That is, the above-mentioned steps 1 to 13 are sequentially performed, which enables to easily extract wine without causing contact of wine inside the bottle with air.

Figure 19:
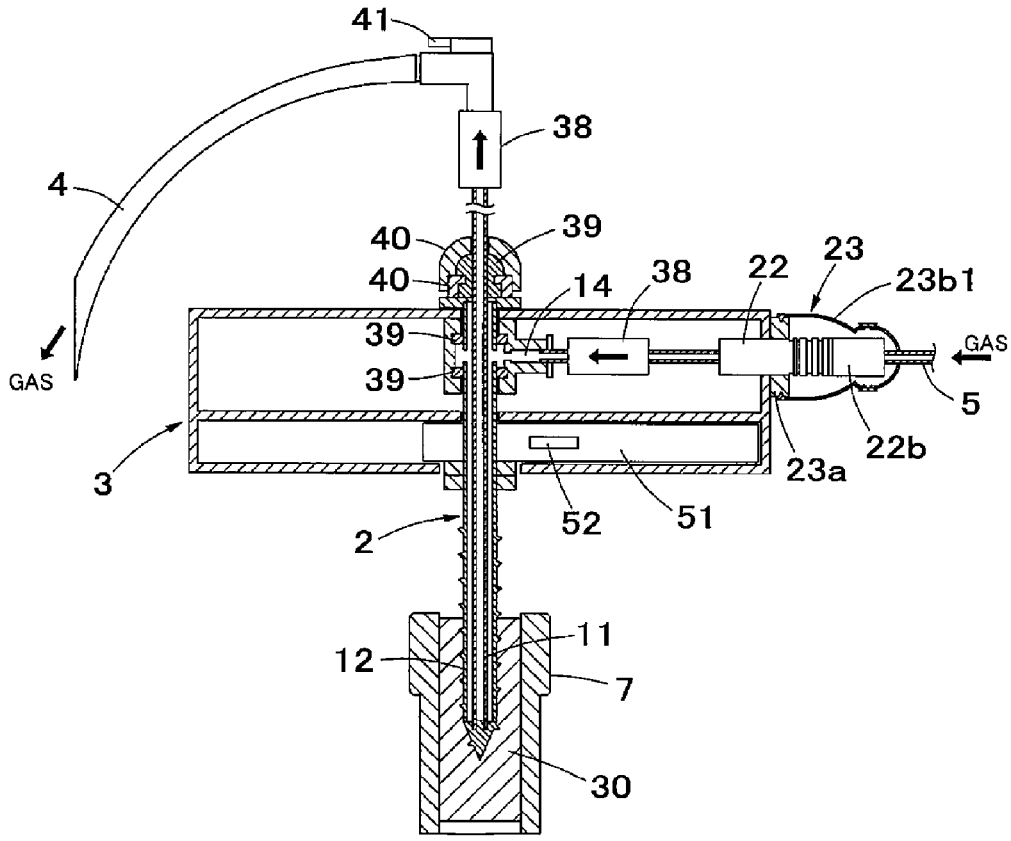
FIG. 19 is a cross-section view to show a usage state of a penetration element and a body of a beverage server system according to the fifth embodiment.
Figure 20:
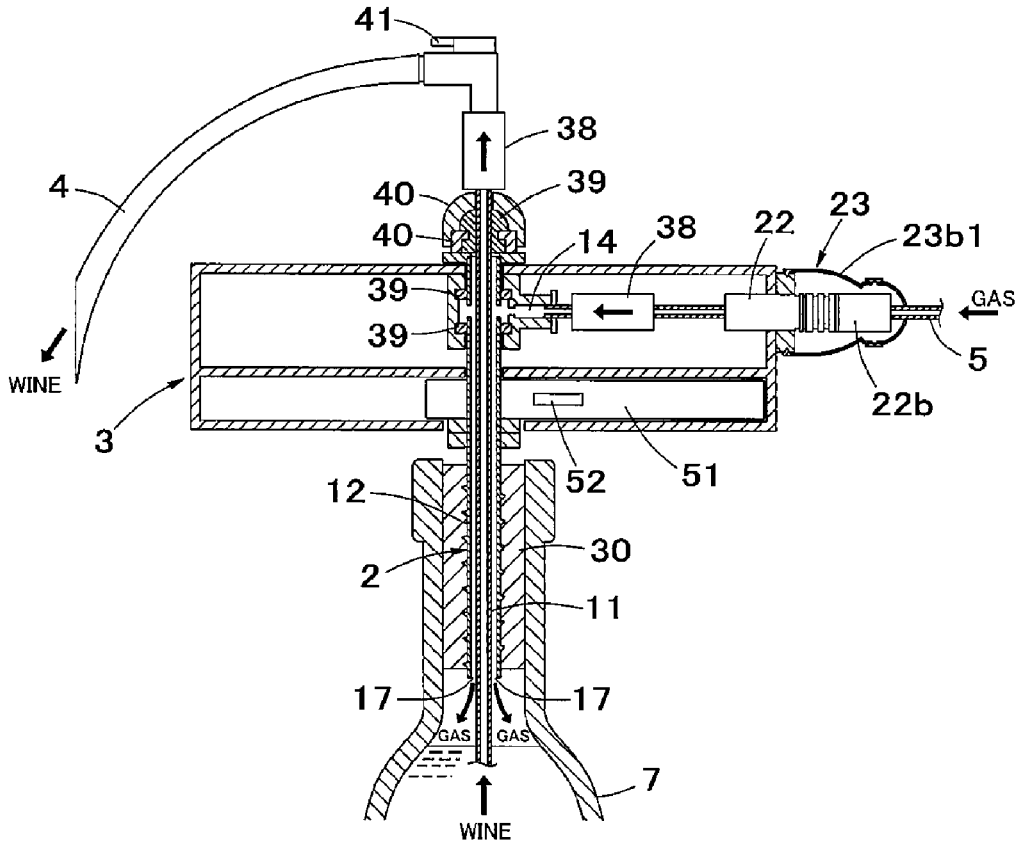
FIG. 20 is a cross-section view to show a usage state of a penetration element and a body of a beverage server system according to the fifth embodiment.

FIG. 19 shows a state of steps 2 and 3, and FIG. 20 shows a state of step 13, respectively.

Also, a method for an aftertreatment is the same as the one described in the fourth embodiment.

In addition, because the beverage server system of the fifth embodiment comprises the ratchet mechanism, a gas supply channel (5) is not obstructive (it does not tangle with the body) when puncturing the cork with the penetration element (2). Therefore, this beverage server system has an advantage that a removal-attachment of the gas supply channel (5) against the body (3) is just once.

Figure 21:
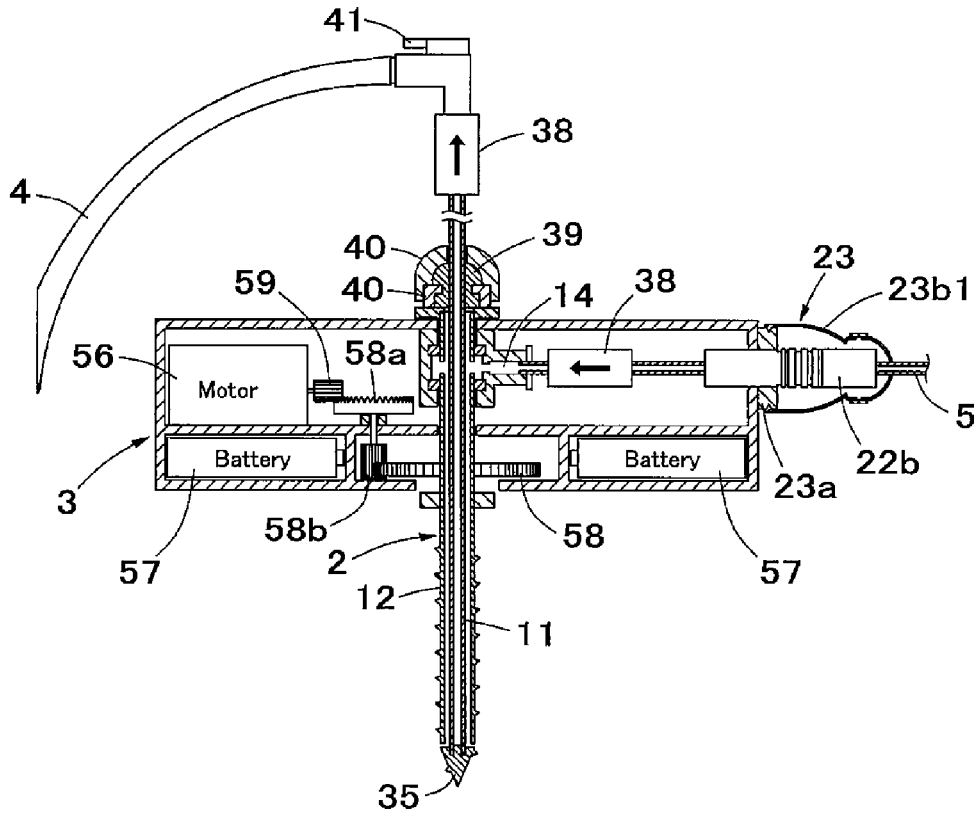
FIG. 21 is a front cross-section view of a penetration element and a body of a beverage server system according to the sixth embodiment.

FIG. 21 is a front cross-section view of a penetration element and a body of a beverage server system according to the sixth embodiment.

The beverage server system according to the sixth embodiment has also many structures common to the above-described fourth embodiment. In order to avoid repeating descriptions, the same reference numbers are given to the same structures and their explanations are omitted. However, even the same structures may be shown with different shapes and positioned in the fourth embodiment and the sixth embodiment.

A beverage server system according to the sixth embodiment comprises a body (30) in which a motor (56) for independently rotating a penetration element (2) from the body (3) and a battery (57) for supplying power to the motor (56) are incorporated. The battery (57) may be a dry cell battery or a rechargeable battery.

The motor (56) is fixed to the body (3), and a pinion (59) is attached to a rotating shaft of the motor (56). Via two cogwheels (58*a*) (58*b*), the pinion (59) meshes with a cogwheel (58) fitted onto a gas injection conduit (12) which constitutes an outer tube of the penetration element (2).

Accordingly, the penetration element (2) independently rotates from the body (3) when the motor (56) rotates. This enables to operate the puncture through the cork with the penetration element in a substantially automatic way, which results in reducing an amount of human labor.

In addition, the motor (56) is reversely rotatable, and the reversing rotation of the motor enables to easily pull out the penetration element from the cork.

In the present invention, according to the above-described fourth to sixth embodiments, it is possible to reverse a positional relationship between the beverage extraction conduit (11) and the gas injection conduit (12) in the penetration element (2).

That is, the penetration element (2) may have a double tube structure, wherein the beverage extraction conduit (11) is an outer tube and the gas injection conduit (12) is an inner tube (Hereinafter, this is referred to as "reverse double tube structure"). When the reverse double tube structure is adopted, the gas injection conduit (12) is movable along the beverage extraction conduit (11), and the movement changes its protrusive amount from a tip of the beverage extraction conduit (11).

Figure 22:
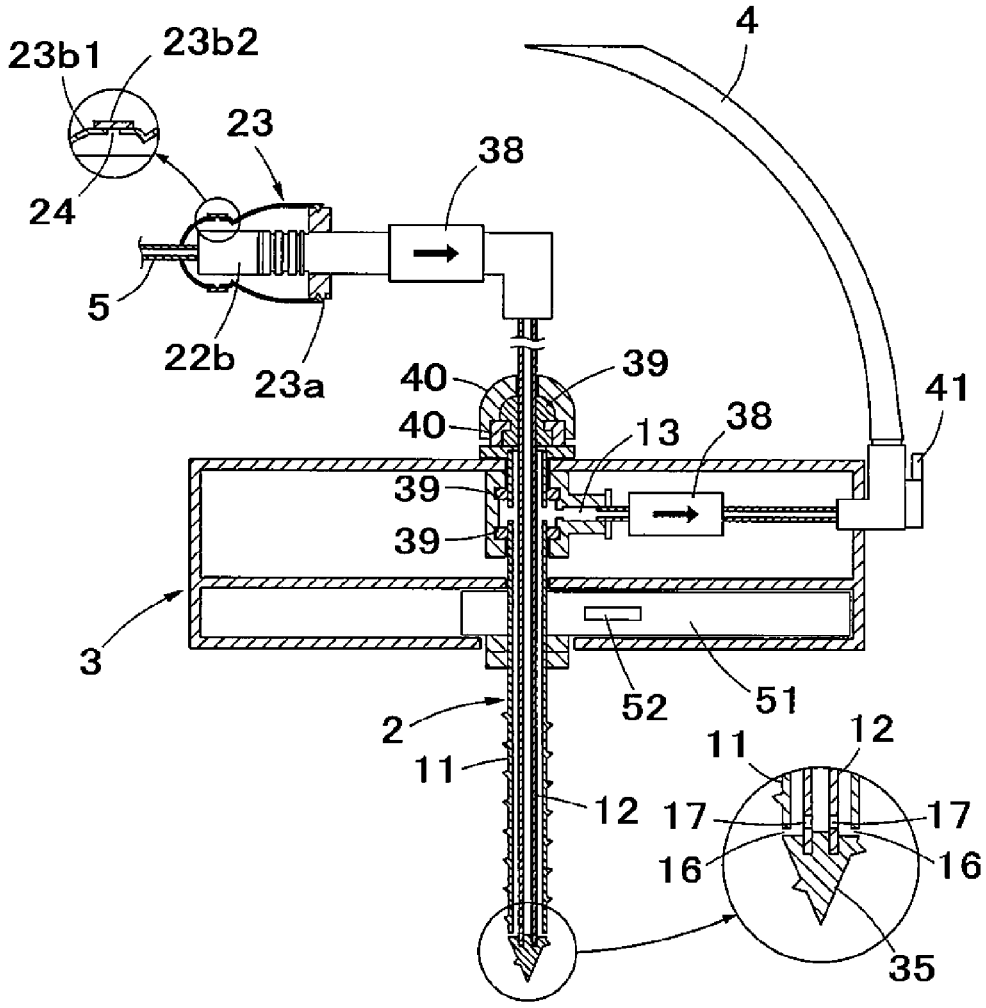
FIG. 22 is a front cross-section view of a penetration element and a body of a beverage server system when the reverse double tube structure is adapted to the fifth embodiment (seventh embodiment).

FIG. 22 is a front cross-section view of a penetration element and a body of a beverage server system when the reverse double tube structure is adapted to the fifth embodiment (Hereinafter, referred to as the seventh embodiment).

In FIG. 22, the same structures as the fifth embodiment shown in FIG. 18 have the same reference numbers.

In the seventh embodiment, a penetration element (2) comprises a beverage extraction conduit (11) as an outer tube and a gas injection conduit (12) as an inner tube. The beverage extraction conduit (11) has a thread on its outer circumference surface.

The gas injection conduit (12) is configured to linearly penetrate through the body (3) in an up-down direction so as to double as a gas injection channel (14).

A gas supply channel (5) is removably connected to a top end of the gas injection conduit (12) via a check valve (38) and a cap joint (23).

The beverage extraction conduit (11) is communicated with a beverage extraction channel (13) provided in the body (3). A beverage discharge channel (4) is removably connected to the beverage extraction channel (13) via a check valve (38).

Next, an operation for extracting wine according to the beverage server system of the seventh embodiment will be explained.

(i) Puncture to Cork

At first, the steps 1 to 5 explained in the extraction operation according to the fourth embodiment is performed. Thereafter, a part in which a beverage extraction port (16) is formed (a bottom end of the beverage extraction conduit (11)) is penetrated through the cork (30) and entered into the bottle such that it does not reach to the wine (step 6).

Next, the gas injection conduit (12) is moved along the beverage extraction channel (11) and moved upward with an angle until the gas injection port (17) reaches adjacent to a bottom of the bottle (7) (step 7). At this time, because the beverage extraction port (16) is located adjacent to a mouth of the bottle, the gas injection port (17) is located upper and separated from the beverage extraction port (16).

Here, a packing (40) is fastened in order to prevent gas from leaking through an upper end of the gas injection conduit (12) when the gas pressure inside the bottle (7) rises resulting from a gas injection operation (step 8).

Figure 23:
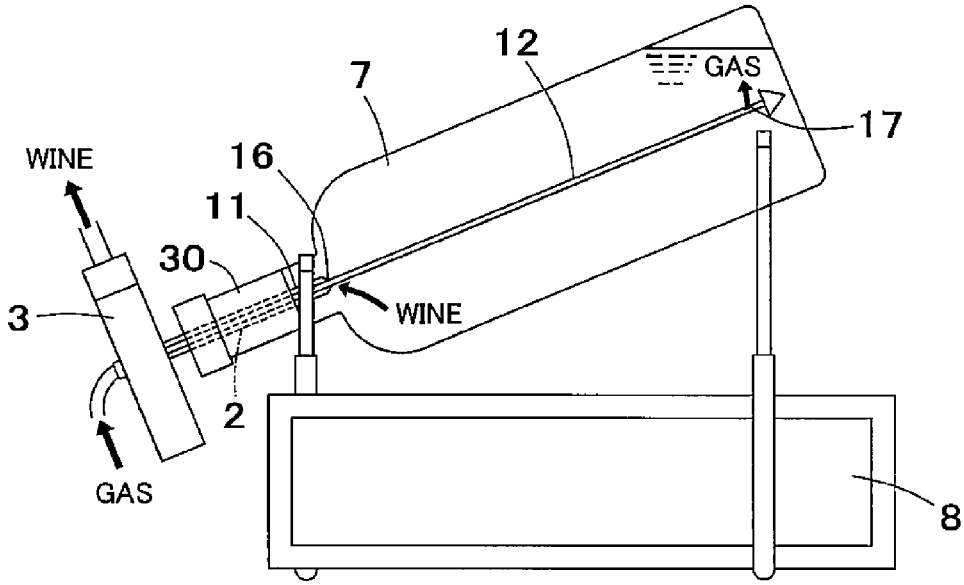
FIG. 23 is a view to explain a wine extraction operation in a beverage server system according to the seventh embodiment.

Then, as shown in FIG. 23, the bottle (7) is held in a rack by tilting the mouth of the bottle lower than the bottom thereof (ii) Wine Extraction (Gas Injection)

After mounting the beverage discharge conduit (4) on the body (3), outgas is operated in a cap joint (23) as the same method as the fourth embodiment, and a gas supply channel (5) is connected to the gas injection conduit (12).

Next, a glass is set. After opening a lever (41), gas is transferred from the gas canister (6) so as to raise gas pressure inside the bottle (7). Then, gas accumulating above the wine presses a liquid surface of wine, and therefore wine enters through the beverage extraction port (16) and passes through the beverage extraction conduit (11) to be slowly poured into the glass from a beverage discharge channel (4).

In addition, when it is required to add the wine a little more, a small amount of gas is supplied to extract a small amount of wine. When the wine reaches to a desired amount, the lever (41) is closed.

(iii) Aftertreatment

The wine bottle with the remaining wine may be preserved by keeping the tilted position or preserved in a lateral or upright position, and aftertreatments such as an outgassing operation are not required.

According to the beverage server system of the seventh embodiment, the gas injection port (17) is located distantly from the beverage extraction port (16) during the extraction operation, and therefore even a stir-up of wine lees due to the gas injection does not cause an entry of lees through the beverage extraction port (16). When an amount of wine is slightly decreased, the gas extraction port (17) is not soaked with the wine so that the stir-up of wine lees does not occur. Therefore, it is more difficult for lees to enter into the beverage extraction port (16).

In addition, the beverage extraction port (16) is blocked with a tip end (35) of the gas injection conduit (12) when puncturing through the cork (30) with the penetration element (2), which results in preventing the powder of the cork (30) from clogging into the beverage extraction port (16).

Further, the gas injection port (17) is covered with the beverage extraction conduit (11) when puncturing through the cork (30) with the penetration element (2), which results in preventing the powder of the cork (30) from clogging into the gas injection port (17).

In the beverage server system according to the fourth to the sixth embodiments, a cover (53) (See FIG. 18) may be covered over a check valve (38) to improve its appearance.

The cover (53) has a structure in which plural cylinders having different diameters are combined, and it is retractable as shown with an arrow. Specifically, the cover (53) is configured that a cylinder with a smaller diameter is fit into a cylinder with a larger diameter to be short, and the cylinder with the smaller diameter is exposed from the cylinder with the larger diameter to be long.

Such the cover (53) covers over the check valve (38). Accordingly, it is possible to cover over and hide the beverage extraction conduit (11) protruding above the body (3) on the check valve (38) and its below. The length of the beverage extraction conduit (11) protruding above the body (3) changes upon use as shown in FIGS. 18 and 20, however, the retractability of the cover (53) enables to cover over and hide the beverage extraction conduit (11) in corresponding to the change of the protrusive length.

Figure 24:
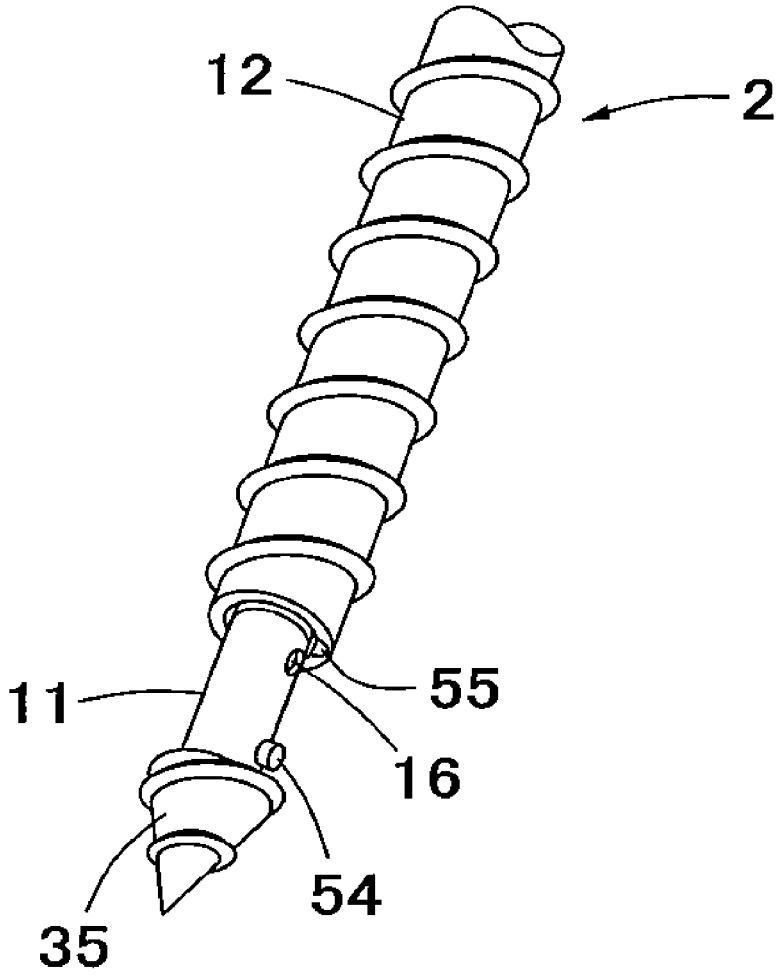
FIG. 24 shows a tip end of the penetration element of the beverage server system according to the fourth to the sixth embodiments.

FIG. 24 shows the tip end of the penetration element (2) of the beverage server system according to the fourth to the sixth embodiments.

As described above, the penetration (2) has the double tube structure, wherein the beverage extraction conduit (11) is the inner tube and the gas injection conduit (12) is the outer tube. Also, the beverage extraction conduit (11) is movable along the gas injection conduit, and the movement changes its protrusive amount from the tip of the gas injection conduit (12). A projection (54) is provided on an outer circumference surface of the beverage extraction conduit (11), and a cutout (55) is provided on an inner surface of the lower end of the gas injection conduit (12). They work as a stop rotation mechanism. Under a state that the beverage extraction conduit (11) is incorporated into the gas injection conduit (12), the projection (54) is fitted into the cutout (55), which leads to integrally rotate the beverage extraction conduit (11) and the gas injection conduit (12).

In addition, the penetration element (2) of the beverage server system according to the seventh embodiment has a structure in which the beverage extraction conduit (11) is the outer tube and the gas injection conduit (12) is the inner tube, and the rest structures are the same as the ones shown in FIG. 24.

Figure 25:
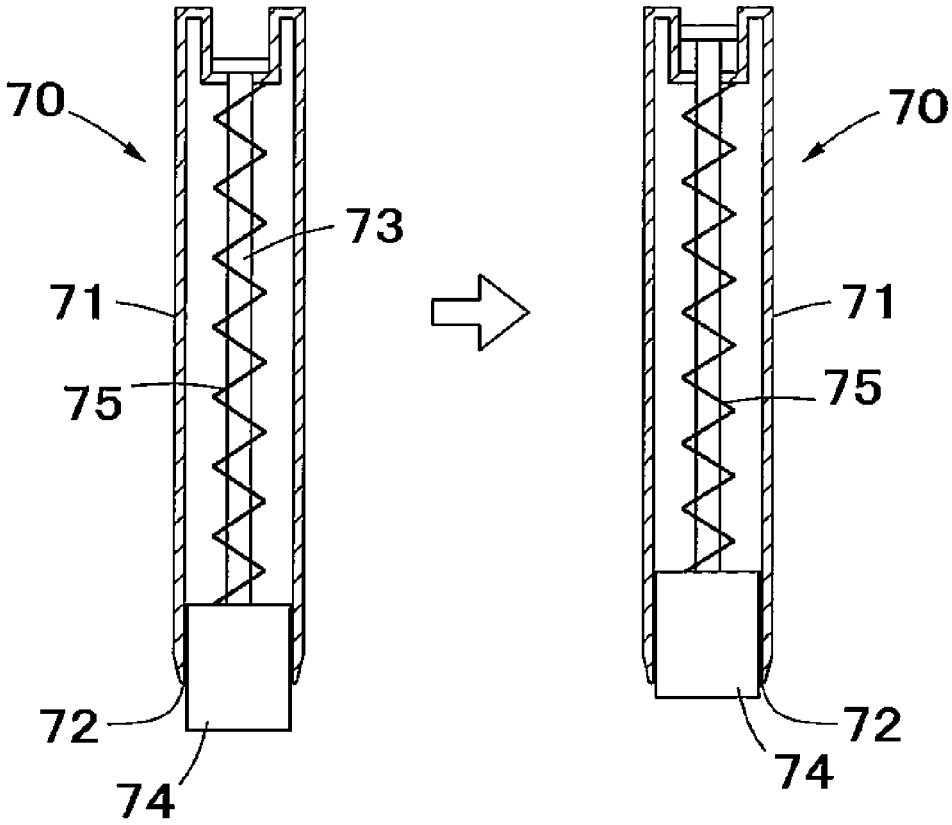
FIG. 25 is a cross-section view to show one example of a jig to be preferably used for cutting only a middle part of a cap seal.

FIG. 25 shows one example of the above-mentioned jig to be preferably used for cutting only the middle part of the cap seal before puncturing the cork with the penetration element (Hereinafter, referred to as a cut jig).

The cut jig (70) comprises a hollow cylindrical body (71) to be held by a user, and a movable part provided at an inner space of the body (71).

A tip of the body (71) is open, and a periphery of the open part is formed into a cutting blade (72) with an acute angle.

The movable part comprises a shaft (73) extended along a longitudinal direction of the body in the inner space of the body (71), a cylindrical tip end (74) fixed to a tip of the shaft (73) and appearing and receding from an open part of the body (71), and a coil spring (75) provided to wind around the shaft (73) and bias the tip end (74) toward the tip side of the body (71) (downside in the figure).

Figure 26:
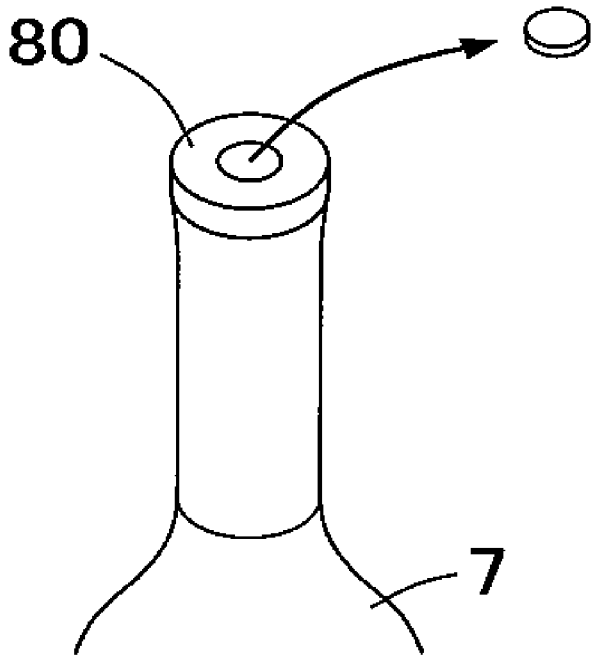
FIG. 26 shows a state that only the middle part of the cap seal is roundly cut by a cutting jig.

In normal time, the tip end (74) protrudes from the lower end of the body (71) due to the bias of the spring (75) (See the left side figure). Upon use, under a state that a tip surface of the tip end (74) contacts with a top surface of the cap seal, the body (71) is pressed downwardly. Then, the spring (75) contracts so as to internally retract the tip end (74) from the tip of the body (71), which leads to protrude the cutting blade (72) from the tip end of the body and roundly cut only the middle part of the cap seal (See FIG. 26).

Recently, due to reasons of a low price and an easy opening, a wine of which bottle mouth is sealed with an aluminum cap (screw cap) is increased.

Figure 27:
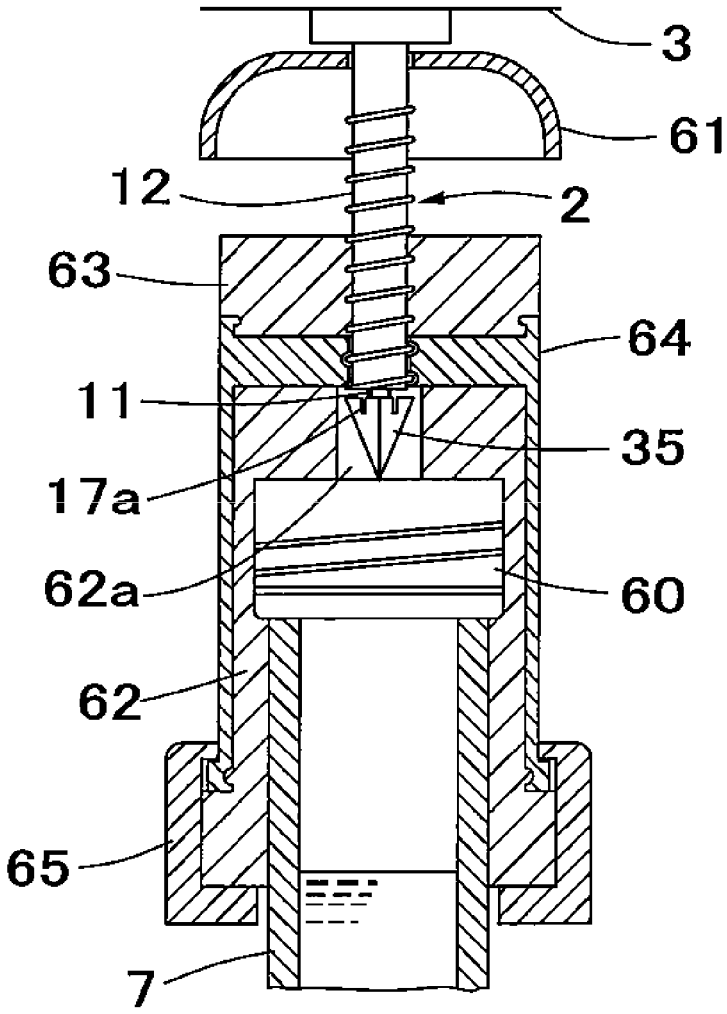
FIG. 27 is a cross-section view to show a state that the beverage server systems of the fourth to the sixth embodiments are applied to the wine of which bottle mouth is sealed with an aluminum cap.

FIG. 27 is a cross-section view to show a state that the beverage server systems of the fourth to the sixth embodiments are applied to the wine of which bottle mouth is sealed with an aluminum cap.

A penetration element (2) used in this case (Hereinafter, referred to as "an aluminum stopper penetration element") has a slightly different structure from the above-mentioned penetration element (Hereinafter, referred to as "a cork penetration element") used for wine of which bottle mouth is sealed with a cork.

These two kinds of penetration element are appropriately used (exchanged) depending on the stopper types of wine.

Hereinafter, structures of the aluminum stopper penetration element which are different from the one of the cork penetration element will be explained, and the same structures have the same reference numbers, and their explanations are omitted.

The aluminum stopper penetration element has a double tube including the beverage extraction conduit (11) and the gas injection conduit (12) as the same as the cork penetration element, however, it does not comprise a stop rotation mechanism (a projection (54) and a cutout (55)) such as the one shown in FIG. 24. Accordingly, a rotation of the gas injection conduit (12) does not rotate the beverage extraction conduit (11).

A cover (61) having a downward-receiving-plate shape is fit onto the gas injection conduit (12), and movable in an up-down direction along the gas injection conduit (12).

The aluminum stopper penetration element has a conical tip end (35) of the beverage extraction conduit (11), and a structure of the tip end (35) is also slightly different from the cork penetration element.

Figure 28:
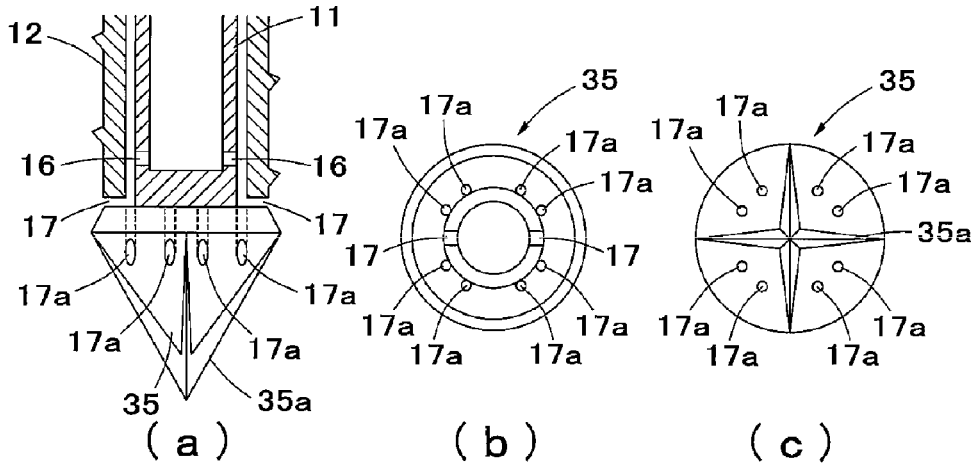
FIG. 28 is an enlarged view of the tip end of a beverage extraction conduit shown in FIG. 27, and (a) is a front view, (b) is a plane view, and (c) is a bottom view.

FIG. 28 is an enlarged view of the tip end (35), and (a) is a front view, (b) is a plane view, and (c) is a bottom view.

A maximum diameter of the tip end (35) is slightly larger than that of the gas injection conduit (12) (outer diameter of a thread part), and an arrow-tip-shaped projection (35*a*) is formed at a tip of the tip end (35). Further, a penetration hole (17*a*) penetrating from a top surface of the projection (35*a*) toward a side surface thereof is provided.

The penetration hole (17*a*) consists of plural holes arranged circularly, and enables to discharge gas coming through the gas injection conduit (12) from the top surface to the side surface.

When the aluminum stopper penetration element is used, an opening-stopper assistant cap is mounted on a mouth of the bottle (7) as shown in FIG. 27.

The opening-stopper assistant cap comprises a cylindrical silicon packing (62) for covering a side surface adjacent to the mouth of the bottle (7) and a top and side surfaces of the aluminum cap (60), a cylindrical metal cover (64) for covering a side surface from a top end toward near a bottom end and a top surface of the silicon packing (62), a silicone packing (63) for covering a top surface of the metal cover (64), and a fastener (65) for fastening from the outside and fitting onto the silicon packing (62) and a side surface of the lower end of the metal cover (64).

The silicon packing (62) has a vertical penetration hole (62*a*) above the aluminum cap (60). A diameter of the penetration hole (62*a*) is configured to be larger than a maximum diameter of the tip end (35), and an upper part of the penetration hole (62*a*) is blocked with the metal cover (64) before use.

The silicone packing (63) and the metal cover (64) show a punctured state with the penetration element (2) in figure, however, they do not have a hole before use.

Hereinafter, a method for using the aluminum stopper penetration element will be explained.

First, the opening-stopper assistant cap is mounted on the mouth of the bottle (7).

Next, the cover (61) fitting onto the gas injection conduit (12) is transferred downward, and the cover (61) covers over and fixes the silicon packing (63). At this time, because an inner surface of an outer circumference of the cover (61) is a curved surface, an upper part of the outer edge of the silicon packing (63) is strongly pressed with the inner surface of the cover (61), which results in high airtightness.

Then, the gas injection conduit (12) is rotated to insert the tip end (35) into the opening-stopper assistant cap until the tip end (35) reaches to a top surface of the aluminum cap (60). At this time, the tip end (35) is located so as not to prick and break into the aluminum cap (60), as shown in FIG. 27.

Under the state, the silicon packing (63) is closely attached to the side surface of the gas injection conduit (12), and the penetration hole (62*a*) becomes an enclosed space.

Under the state, gas is supplied from a gas canister through the gas injection conduit (12). Then, gas passes from the gas injection conduit (12) through the gas injection port (17) and the penetration hole (17*a*) and reaches to the penetration hole (62*a*) which is an enclosed space. Thereafter, the gas passes through the beverage extraction port (16) and the beverage extraction conduit (11) to be discharged from the beverage extraction channel (13*c*).

This results in purging air inside not only the gas injection conduit (12) but also the beverage extraction conduit (11) and the beverage extraction channel (13).

Next, as well as the cork penetration element as described above, the cap body (23*b*$_1$) and the cap receiving part (23*a*) are removed, and the jointing-part (22) and the jointed-part (22*b*) are removed (when a ratchet mechanism is provided, this operation is not required.).

After that, the gas injection conduit (12) is rotated and lowered. At this time, because a stop rotation mechanism is not provided to the aluminum stopper penetration element, the beverage extraction conduit (11) lowers with no rotation and pricks and breaks into the aluminum cap (60). Although the tip end (35) of the beverage extraction conduit (11) does not rotate, the equipment of the arrow-tip-shaped projection (35*a*) enables to easily prick and break into the aluminum cap (60).

As described, it is possible to prick and break into the aluminum cap (60) without rotating the tip end (35). This results in preventing a grinding of the aluminum cap (60) into an aluminum powder which is to be fallen into the bottle.

Next, the gas injection conduit (12) is penetrated through the aluminum cap (60) and entered into the bottle such that it does not reach to the wine.

The gas injection conduit (12) is not allowed to lower more than this position. Accordingly, the gas injection port (17) does not touch the wine, which results in not generating the bubble of gas inside the wine and in preventing lees of the wine from stirring up.

After that, operation of the steps 7 to 13 explained in the fourth embodiment is subsequently performed, which enables to easily extract wine without causing contact of wine inside the bottle with air. Further, a method for aftertreatment is the same as the one in the fourth embodiment.

The above-mentioned aluminum stopper penetration element may be applied to the beverage server system of the seventh embodiment.

In this case, the stopper penetration element may have a beverage extraction conduit (11) as the outer tube, and a gas injection conduit (12) as the inner tube.

Figure 29:
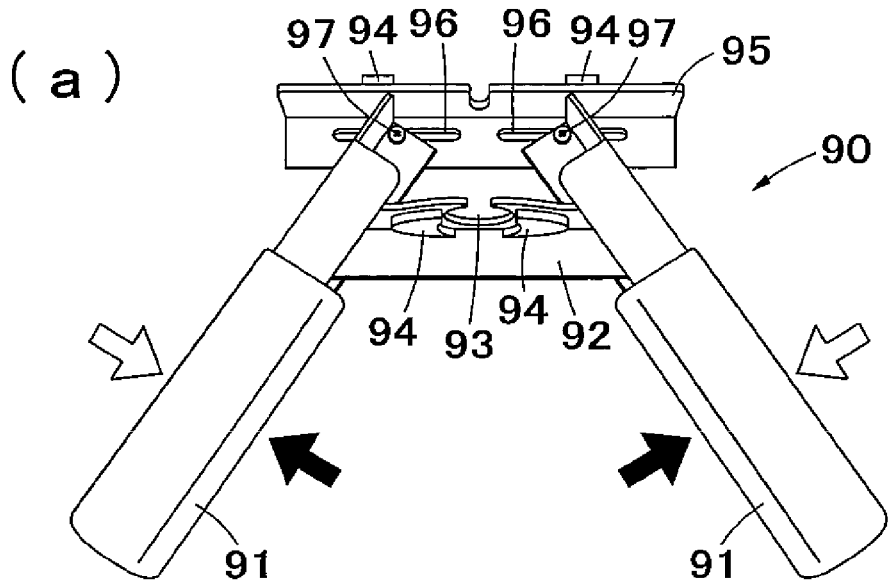
FIG. 29 (*a*) is a rear view of a cork-drawn jig, and (b) is a front view of the cork-drawn jig.
Figure 29:
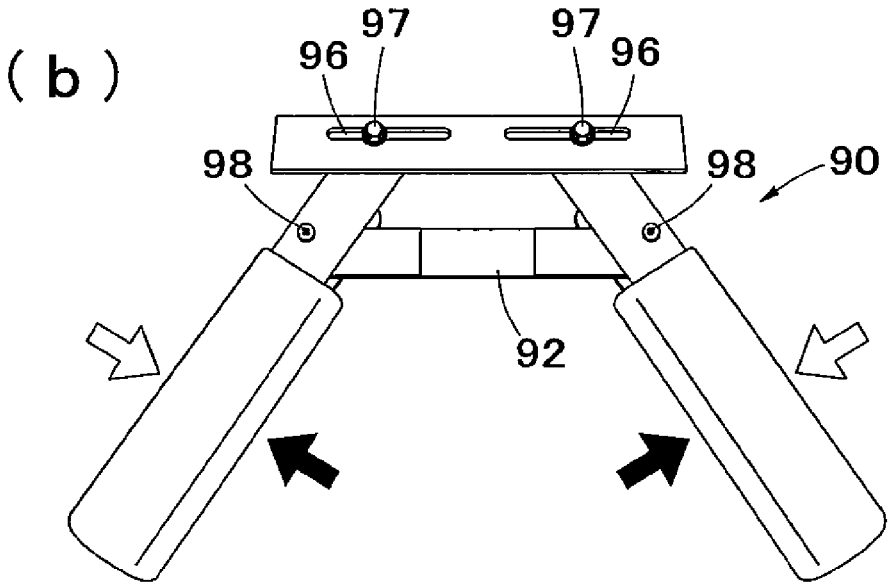

In the beverage server system according to the above-mentioned fourth to seventh embodiments, it is possible to use a cork-drawn jig (90) as shown in FIG. 29 for pulling out the cork from the bottle after wine is extracted.

FIG. 29 (*a*) is a rear view of the cork-drawn jig (90), and FIG. 29 (*b*) is a front view of the cork-drawn jig (90).

The cork-drawn jig (90) comprises a pair of left and right rod-shaped handles (91) to be used as grips, a lower connection pole (92) for connecting longitudinal middle parts of the pair of left and right handles (91), and an upper connection pole (95) for connecting longitudinal tip ends of the pair of left and right handles (91).

The lower connection pole (92) has an L-shape in a cross section, wherein a horizontal plate and a perpendicular plate are united at a right angle. Both ends of the lower connection pole (92) are respectively connected to the handles (91) and movable around left and right connection parts (98) as fulcrums. That is, it is possible to change an angle between the handle (91) and the lower connection pole (92). Therefore, a widening of the left and right handles (91) in a black arrow direction as shown in the figure enables to make the left and right handles (91) and the lower connection pole (92) in a straight line.

In the horizontal plate of the lower connection pole (92), a circular cutout (93) is formed at its longitudinal middle part. In a back side of the horizontal plate of the lower connection pole (92), elastic plates (94) such as rubber are attached around the cutout (93). An inner diameter of the cutout (93) is configured to be smaller than a mouth diameter of the bottle (7) and larger than an outer diameter of the cork (30).

The upper connection pole (95) has an L-shape in a cross section, wherein a horizontal plate and a perpendicular plate are united at a right angle. Two elastic plates (94) such as rubber are attached on a surface of the horizontal plate and symmetrically positioned from its middle.

Also, in the perpendicular plate, two long holes (96) extending in a longitudinal direction are symmetrically formed from its middle.

Screws (97) are respectively inserted into the two long holes (96), and these two screws (97) are respectively connected to tip ends of the left and right handles (91). Accordingly, the handles (91) are attached to the upper connection pole (95) such that they are movable around the upper connection pole (95) and slidable along the long holes.

Therefore, a widening of the left and right handles (91) in a black arrow direction as shown in the figure enables to make the left and right handles (91) and the upper connection pole (95) in a straight line. Also, when the left and right handles (91) and the upper connection pole (95) are positioned in a straight line, the upper connection pole (95) and the lower connection pole (92) are lapped over.

Further, the lower connection pole (92) and the upper connection pole (95) are parallel to each other, and it is possible to change a distance of each other with keeping the parallel relationship.

Hereinafter, a method for using the cork-drawn jig (90) will be explained.

First, under a state that the wine extraction shown in FIG. 16 and FIG. 20 is completed, after the cap seal is removed, the left and right handles (91), the upper connection pole (95) and the lower connection pole (92) are positioned in a straight line. Under the state, the cork-drawn jig (90) is inserted and placed into a gap between the bottle (7) and the body (3).

At this time, the elastic plates (94) on the back side of the horizontal plate of the lower connection pole (92) are contacted with a top surface of a mouth of the bottle (7), and the elastic plates (94) on the surface of the horizontal plate of the upper connection pole (95) is contacted with a bottom surface of the body (3), and the penetration element (2) is inserted into the cutout (93).

Next, the left and right handles (91) are pressed in a white arrow direction shown in FIG. 29, and the lapped upper connection pole (95) and lower connection pole (92) are separated in an up-down direction as shown in FIG. 29.

Here, because the upper connection pole (95) is contacted with the body (3) and the lower connection pole (92) is contacted with the bottle (7), the body (3) tries to be away from the bottle (7) when the upper connection pole (95) and the lower connection pole (92) are separated in the up-down direction, and the cork (30) is pulled out from the bottle (7).

As described, the use of cork-drawn jig (90) enables even for a strengthless woman to very easily pull out the cork from the bottle. Further, it is possible to prevent a fallen cork powder into wine. Further, when the cork-drawn jig is applied to the fourth to sixth embodiments in which their bottle position during the extraction is uprighted, wine does not adhere to the body, which enables to omit its maintenance and washing labor.

Next, a wine rack used for a beverage server system according to the present invention will be explained by referring to FIGS. 30 to 33.

A wine rack (43) shown in FIGS. 30 to 33 enables to serve wine with changing an angle of wine bottle.

Figure 30:
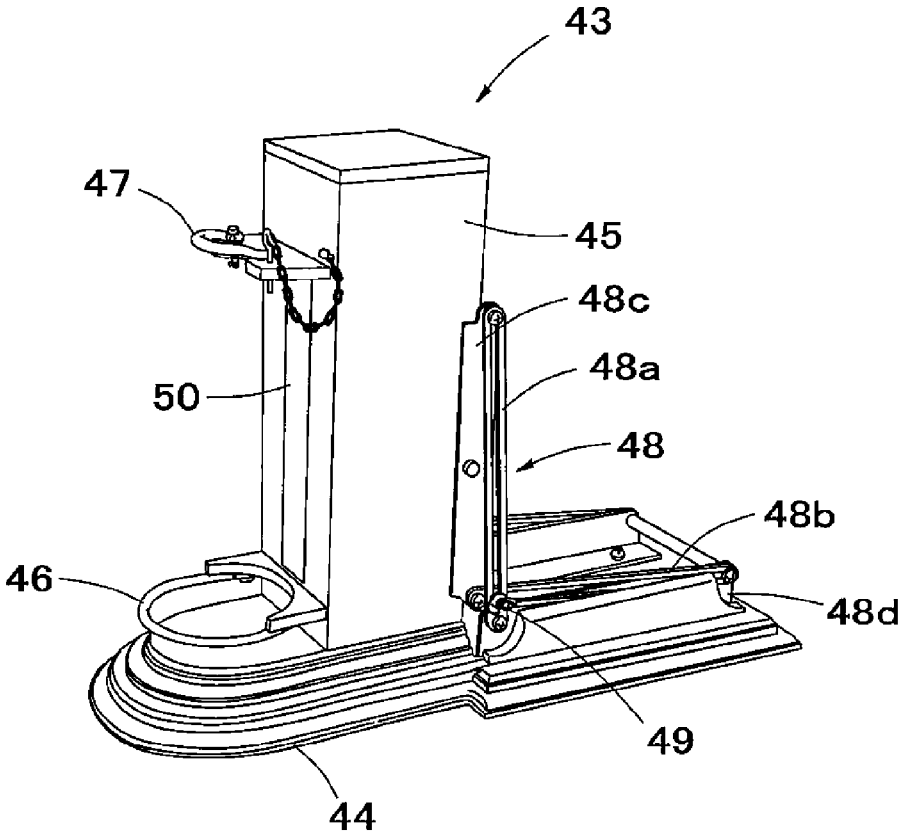
FIG. 30 is a perspective view of a wine rack made of a wooden box with an X-shaped arm.

FIG. 30 is a perspective view of a wine rack made of a wooden box having an X-shaped arm.

Figure 31:
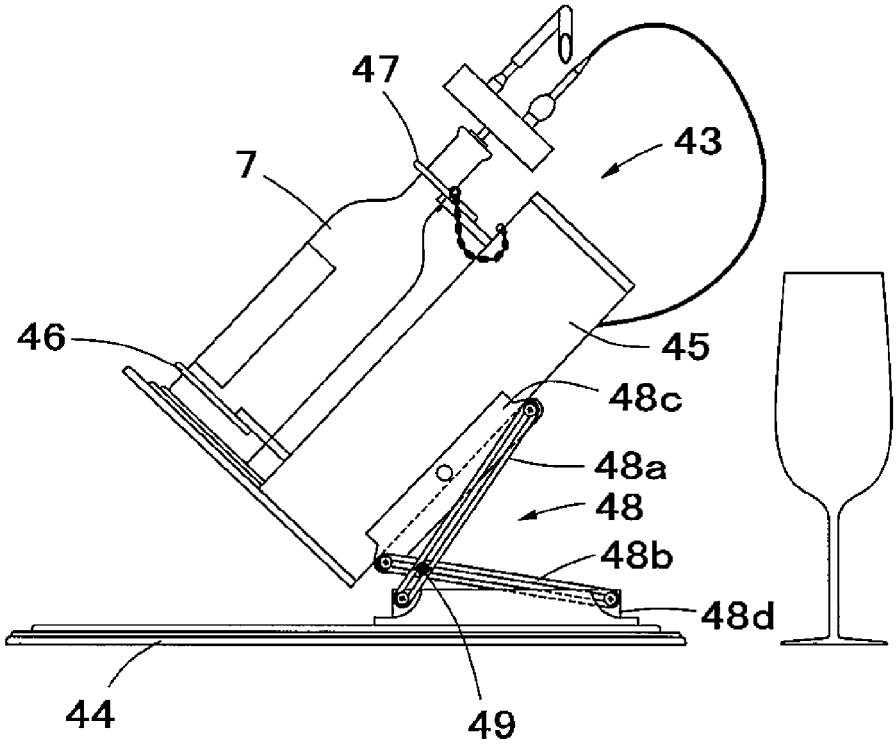
FIG. 31 is a side view to show a state that a bottle is placed in a wine rack and the wine rack is tilted at about a 45 degree angle.

FIG. 31 is a side view to show a state that a bottle is placed in the wine rack and the wine rack is tilted at a 45 degree angle.

Figure 32:
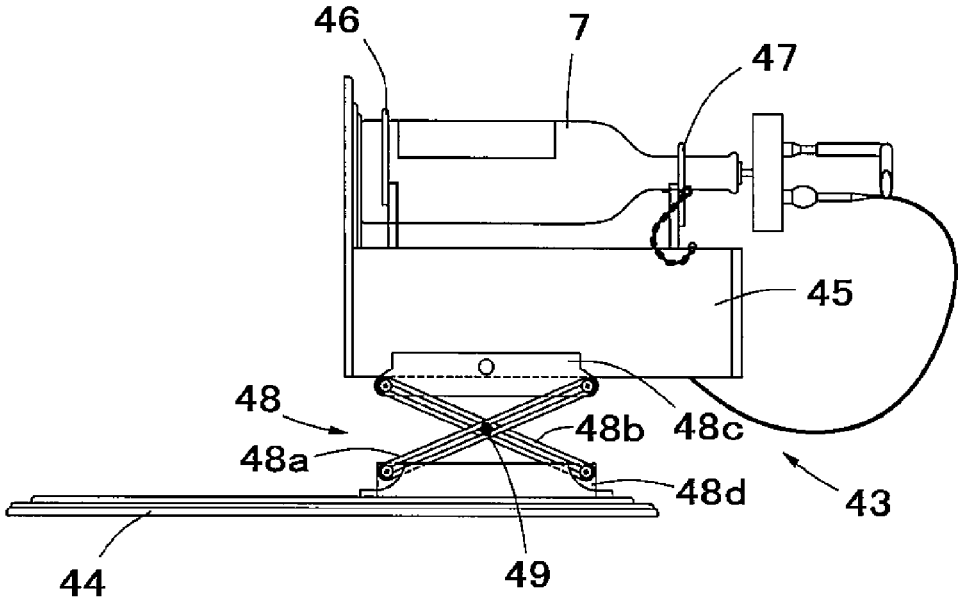
FIG. 32 is a side view to show a state that the wine rack is tilted at a 90 degree angle to be a lateral position.

FIG. 32 is a side view to show a state that the wine rack is tilted at a 90 degree angle to be a lateral position.

Figure 33:
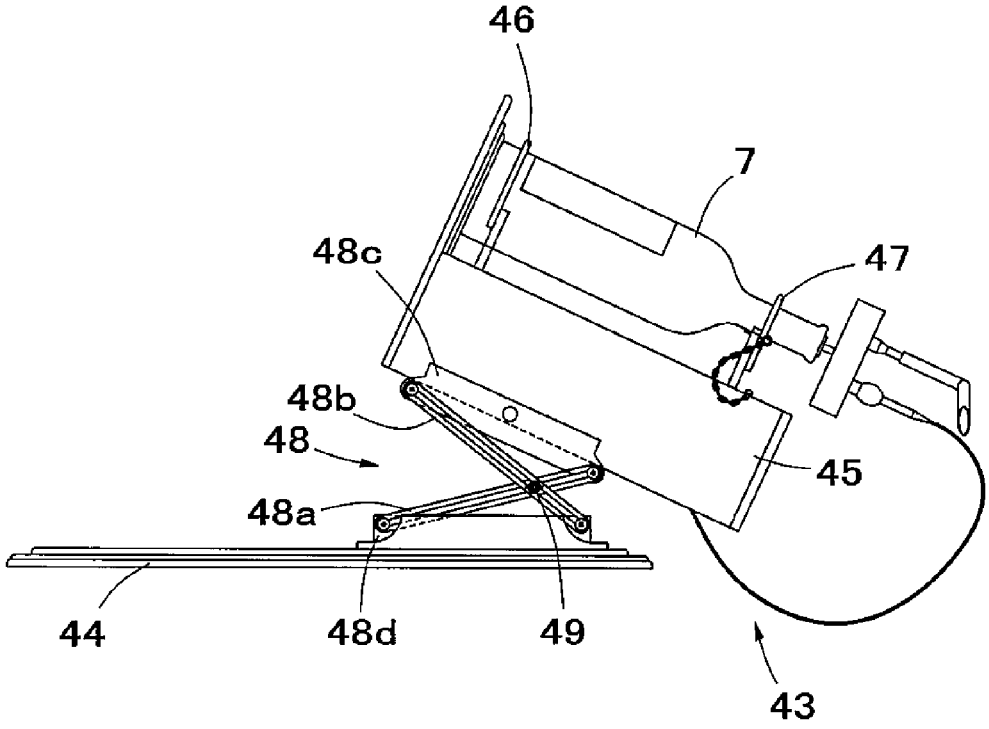
FIG. 33 is a side view to show a state that the wine rack is tilted at about a 135 degree angle.

FIG. 33 is a side view to show a state that the wine rack is tilted at a 135 degree angle.

As shown in FIG. 30, the wine rack (43) comprises a ring holder (46) for supporting a lower part of the bottle (7) and a holder (47) for supporting a bottle neck on a front surface of a wooden box (45) which is perpendicularly placed on a wooden base (44).

An X-shaped arm (48) is removably attached on a back surface of the wooden box (45) and capable of tilting the wooden box (45) in a back surface direction and changing an angle of the wooden box (45).

The X-shaped arm (48) comprises two arms (48*a*) (48*b*) crossed in an X shape, and a slit is provided to each arm (48*a*) (48*b*) along a longitudinal direction. To an intersection of the slits, a pole is orthogonally inserted against each arm (48*a*) (48*b*), and the pole is slidable along the slits.

The X-shaped arm (48) is fixed with an angle by fastening a butterfly nut (49) provided at an end of the pole placed between the both arms (48*a*) (48*b*). In addition, a rubber washer is interposed between the butterfly nut (49) and the X-shaped arm (48) for providing a friction so as not to easily slide the pole along the slits and for fixing the angle of the X-shaped arm (48).

One end of the arm (48*a*) and one end of the arm (48*b*) are respectively connected to a support plate (48*c*), and the other ends are respectively connected to a support plate (48*d*). The support plate (48*c*) is fixed on the back surface of the wooden box (45), and the support plate (48*d*) is fixed to the base (44).

Further, a battery-powered penlight (not shown) extended in a longitudinal direction (height direction) of the wooden box (45) is incorporated into the wooden box (45). As substitute for the penlight, other lights (light source) such as LED may be used.

On the front surface of the wooden box (45), a transparent plate (50) for covering a rectangular opening extended along its longitudinal direction is provided, and light of the penlight is transmitted through the transparent plate (50). A reflection plate (not shown) is provided on the back surface of the penlight to efficiently transfer light of the penlight to the transparent plate (50). In addition, the transparent plate (50) having a length reaching to a lower end of the wooden box (45) is preferably used because this enables to light a bottom of the bottle.

The wine bottle (7) is laid and preserved so as not to dry the cork during long term storage. However, it is preferable to stand the bottle (7) so as to precipitate lees at the bottom of the bottle (7). The wine rack (43) is very useful in an urgent use which is not possible to stand the bottle (7) for a sufficient time to precipitate lees before the serving and in a case which serves wine including a high amount of lees such as high class vintage wines.

Hereinafter, a method to be used in such the cases will be explained.

As shown in FIG. 31, the bottle (7) is set in the holders (46) (47) on the front surface of the wooden box (45) of the wine rack (43).

For a first glass of wine, bottle (7) is tilted at about a 45 degree angle, and the angle is set not to generate bubbles due to gas provided from the gas canister, and gas is supplied.

When lees exist at a lower part of the bottle (7), there is no problem to continue serving with the state.

On the other hand, when lees exist at an upper part of the bottle (7) (near a mouth of the bottle (7)), a lowering of a liquid surface due to the wine serving causes to lift and stir up the lees existing at the upper part of the bottle (7) toward the liquid surface.

Then, when lees exist at the upper part of the bottle (7), it is preferable to further tilt and adjust the bottle at an angle between 45 to 90 degrees in accordance with the lowered liquid surface, and serve wine with keeping a state of lees soaked in the wine and without causing the stir-up of lees.

Because lees conditions are various depending on the bottles (7), the freely changeable angle of the wine rack (43) enables to appropriately remove lees with observing the lees conditions, even though lees are in any place, upper, middle or lower, of the bottle (7).

At this time, a lightning of the penlight for illuminating the bottle (7) enables to serve wine with confirming the lees position, which is a very easy operation.

Also, as shown in FIG. 33, it is possible to tilt the bottle (7) at about a 135 degree angle so as to make the mouth lower than the bottom of the bottle (7) and perform a removal of lees (decanting) of wine. At this time, the light of the penlight enables to confirm the lees position and perform the operation easily.

INDUSTRIAL APPLICABILITY

The present invention is appropriately used in household, restaurant and so on where do not extract a whole amount of beverage from a bottle such as a corked wine bottle at once, and extract a small amount of beverage every some hours or days.

What is claimed is:

1. A beverage server system for extracting a beverage from a corked beverage bottle without uncorking the bottle, comprising:

a penetration element for penetrating through the cork, the penetration element including a beverage extraction conduit for extracting the beverage in the bottle and a gas injection conduit for injecting gas into the bottle, wherein a gas injection port disposed in the gas injection conduit is located at a level higher than a beverage extraction port disposed in the beverage extraction conduit inside the bottle when extracting the beverage from the bottle through the beverage extraction conduit, the penetration element has a double tube structure in which the gas injection conduit is incorporated into the beverage extraction conduit, the gas injection conduit is movable along the beverage extraction conduit so as to change its protrusive amount from the beverage extraction conduit, and the beverage extraction port opens when moving the gas injection conduit in a direction of increasing its protrusive amount from the beverage extraction conduit.

2. The beverage server system according to claim 1, wherein a thread is formed on an outer circumference surface of the beverage extraction conduit.

3. The beverage server system according to claim 1, wherein a body is provided above the penetration element and extended at a substantial right angle to the penetration element, the body comprising:

a beverage extraction channel for guiding the beverage to outside, the beverage extraction channel communicated with the beverage extraction conduit; and a gas injection channel for introducing gas from outside, the gas injection channel communicated with the gas injection conduit.

4. The beverage server system according to claim 3, comprising:

a beverage discharge channel for discharging the beverage, the beverage discharge channel removably attached to the beverage extraction channel, and a gas supply channel for supplying gas, the gas supply channel removably attached to the gas injection channel.

5. The beverage server system according to claim 4, wherein the gas supply channel comprises at a tip thereof:

a jointed-part to be jointed to a jointing-part, the jointing-part disposed on a tip of the gas injection channel; and a cap for covering an outer circumference of the jointed-part, wherein the cap comprises a valve for discharging gas inside the cap to outside when a pressure inside the cap exceeds a predetermined value, the cap is configured to connect to the body and incorporate the jointing-part and the jointed-part, and an inside of the cap is air-tight when the connection is performed.

6. The beverage server system according to claim 3, wherein the body comprises a ratchet mechanism, and the ratchet mechanism rotates the penetration element in the same direction when rotating the body in one direction, while it does not rotate the penetration element when rotating the body in a reverse direction of the one direction.

7. The beverage server system according to claim 3, wherein the body comprises:

a motor for independently rotating the penetration element from the body; and a battery for supplying power to the motor.

8. The beverage server system according to claim 1, further comprising a rack, wherein the rack incorporates a gas canister therein for supplying gas to the gas injection conduit and holds the beverage bottle above the gas canister by tilting a mouth of the bottle lower than a bottom of the bottle.

9. The beverage server system according to claim 8, wherein the rack comprises a light tool for illuminating an inside of the beverage bottle.

10. The beverage server system according to claim 9, the light tool is placed inside a box, the box incorporating the gas canister therein, and the box comprises a transparent plate on its surface facing the beverage bottle, the transparent plate transmitting light from the light tool.

11. The beverage server system according to claim 1, further comprising a rack, wherein the rack incorporates a gas canister therein for supplying gas to the gas injection conduit and holds the beverage bottle in an upright position.

12. The beverage server system according to claim 11, wherein the rack comprises a light tool for illuminating an inside of the beverage bottle.

13. The beverage server system according to claim 12, the light tool is placed inside a box, the box incorporating the gas canister therein, and the box comprises a transparent plate on its surface facing the beverage bottle, the transparent plate transmitting light from the light tool.

14. The beverage server system according to claim 1, further comprising a rack, wherein the rack incorporates a gas canister therein for supplying gas to the gas injection conduit and holds the beverage bottle at an alterable tilt angle.

15. The beverage server system according to claim 14, wherein the rack comprises a light tool for illuminating an inside of the beverage bottle.

16. The beverage server system according to claim 15, the light tool is placed inside a box, the box incorporating the gas canister therein, and the box comprises a transparent plate on its surface facing the beverage bottle, the transparent plate transmitting light from the light tool.

* * * * *